US010384846B2

(12) United States Patent
Bates et al.

(10) Patent No.: US 10,384,846 B2
(45) Date of Patent: Aug. 20, 2019

(54) ARRANGEMENT OF CONTAINERS IN A CARTON

(71) Applicant: GRAPHIC PACKAGING INTERNATIONAL, INC., Atlanta, GA (US)

(72) Inventors: Aaron Lee Bates, Kennesaw, GA (US); Raymond R. Spivey, Sr., Mableton, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 15/493,747

(22) Filed: Apr. 21, 2017

(65) Prior Publication Data

US 2017/0225858 A1 Aug. 10, 2017

Related U.S. Application Data

(60) Continuation-in-part of application No. 15/148,189, filed on May 6, 2016, now Pat. No. 9,845,182, and a (Continued)

(51) Int. Cl.
*B65D 71/36* (2006.01)
*B65B 21/02* (2006.01)

(Continued)

(52) U.S. Cl.
CPC ..... *B65D 71/36* (2013.01); *B65B 5/06* (2013.01); *B65B 21/06* (2013.01); *B65B 35/40* (2013.01);

(Continued)

(58) Field of Classification Search
CPC .... B65D 71/36; B65D 5/4266; B65D 5/4608; B65D 71/00; B65D 65/00; B65D 21/02;

(Continued)

(56) References Cited

U.S. PATENT DOCUMENTS 902,347 A 10/1908 Tillinghast
1,541,143 A 6/1925 Hoile (Continued)

FOREIGN PATENT DOCUMENTS

BE 671 762 3/1966
CA 2 172 379 12/1995

(Continued)

OTHER PUBLICATIONS

First Examination Report for New Zealand Application No. 713710 dated Nov. 3, 2017.

(Continued)

*Primary Examiner* — Alexander M Valvis
*Assistant Examiner* — Lucas E. A. Palmer
(74) *Attorney, Agent, or Firm* — Womble Bond Dickinson (US) LLP

(57) ABSTRACT

A package comprising a carton and an arrangement of containers. The carton can comprise a plurality of panels extending at least partially around an interior of the carton. The plurality of panels can comprise at least a first panel and a second panel disposed opposite to one another. The arrangement can comprise a number of rows of containers disposed at least partially in the interior of the carton. The arrangement can include at least a first row and a second row extending along the respective first and second panels. A load width of the arrangement can be less than the number of rows multiplied by a first difference between the diameter of the containers approximately an eighth of an inch, and the load width can be greater than the number of rows multiplied by a second difference between the diameter and approximately a half of an inch.

10 Claims, 15 Drawing Sheets

Related U.S. Application Data continuation-in-part of application No. 14/718,361, filed on May 21, 2015, which is a continuation-in-part of application No. 14/286,343, filed on May 23, 2014, now Pat. No. 9,415,915, application No. 15/493,747, which is a continuation-in-part of application No. 15/097,618, filed on Apr. 13, 2016, which is a division of application No. 14/286,343, filed on May 23, 2014, now Pat. No. 9,415,915.

(60) Provisional application No. 62/179,446, filed on May 7, 2015, provisional application No. 61/997,147, filed on May 22, 2014, provisional application No. 61/855,819, filed on May 24, 2013, provisional application No. 61/956,388, filed on Jun. 7, 2013.

(51) Int. Cl.

| | |
|---|---|
| ***B65B 5/02*** | (2006.01) |
| ***B65B 5/06*** | (2006.01) |
| ***B65D 5/42*** | (2006.01) |
| ***B65D 5/468*** | (2006.01) |
| ***B65B 21/06*** | (2006.01) |
| ***B65B 35/40*** | (2006.01) |

(52) U.S. Cl.
CPC ..... *B65D 5/4266* (2013.01); *B65D 5/4608* (2013.01); *B65D 2571/0066* (2013.01); *B65D 2571/00141* (2013.01); *B65D 2571/00728* (2013.01)

(58) Field of Classification Search
CPC ..... B65B 5/024; B65B 5/06; B65B 21/02; B65B 21/242
USPC ..... 53/448; 206/139–203, 431, 427, 558
See application file for complete search history.

(56) References Cited

U.S. PATENT DOCUMENTS 1,913,650 A * 6/1933 White ..... B65D 5/503 206/427
1,925,102 A 9/1933 Levkoff
2,115,673 A 4/1938 Stompe
2,124,808 A 7/1938 White et al.
D124,610 S 1/1941 Norton
2,448,819 A 9/1948 Mitchell
2,535,880 A * 12/1950 Tomkins ..... B65B 5/106 414/789.8
2,554,190 A 5/1951 Hennessey
2,605,035 A 7/1952 Williamson
2,718,301 A 9/1955 Palmer
2,718,313 A * 9/1955 O'Neil ..... B65B 35/50 414/792.5
2,723,027 A 11/1955 Guyer
2,754,047 A 7/1956 Schmidt et al.
2,756,553 A 7/1956 Ferguson
2,782,578 A * 2/1957 Madden ..... B65B 35/50 53/157
2,783,690 A 3/1957 Crary et al.
2,796,709 A 6/1957 Bolding
2,798,603 A 7/1957 Grinspoon
2,800,224 A 7/1957 Taylor et al.
2,842,304 A 7/1958 Ringler
2,849,111 A 8/1958 Fielding
2,854,183 A 9/1958 Srofe
2,868,431 A 1/1959 Painter
2,891,361 A * 6/1959 Walter ..... B65B 5/06 53/157
RE24,667 E 7/1959 Fielding
2,919,844 A 1/1960 Anderson, Jr.
2,922,561 A 1/1960 Currivan
2,928,541 A 3/1960 Fielding
2,929,497 A 3/1960 De Million-Czarnecki
2,930,516 A 3/1960 Fowle et al.
2,974,848 A 3/1961 Fielding
2,975,891 A 3/1961 Stone
2,990,097 A 6/1961 Thompson
3,002,651 A 10/1961 Gauld
3,018,031 A 1/1962 Ahlbor et al.
3,060,659 A 10/1962 Blais
3,080,050 A 3/1963 Fielding
3,176,902 A 4/1965 Champlin
3,178,242 A 4/1965 Ellis
3,207,411 A 9/1965 Farquhar
3,228,582 A 1/1966 Osberg
3,237,762 A 3/1966 Wood
3,252,649 A 5/1966 Graser et al.
3,263,861 A 8/1966 Carr
3,265,283 A 8/1966 Farquhar
RE26,083 E 9/1966 Forrer
3,300,115 A 1/1967 Schauer
3,306,519 A 2/1967 Wood
3,332,594 A 7/1967 Capua
3,339,723 A 9/1967 Wood
3,343,660 A 9/1967 Bailey
3,356,279 A 12/1967 Root
3,356,283 A 12/1967 Champlin
3,373,867 A 3/1968 Wood
3,429,496 A 2/1969 Hickin
3,447,672 A 6/1969 Bailey et al.
3,517,858 A 6/1970 Farquhar
3,540,581 A 11/1970 Koolnis
3,541,757 A 11/1970 Bertrand
3,557,521 A 1/1971 Pierce, Jr.
3,592,000 A * 7/1971 Kapare ..... B65B 21/18 53/247
3,593,849 A 7/1971 Helms
3,599,858 A 8/1971 Samsing
3,635,452 A 1/1972 Helms
3,669,251 A 6/1972 Phillips
3,669,342 A 6/1972 Funkhouser
3,669,343 A 6/1972 Howard
3,688,972 A 9/1972 Mahon
3,747,835 A 7/1973 Graser
3,765,527 A 10/1973 Vargo
3,767,042 A 10/1973 Ganz
3,807,624 A 4/1974 Funkhouser
3,894,681 A 7/1975 Arneson et al.
3,904,036 A 9/1975 Forrer
3,913,739 A 10/1975 Hennessey
3,942,631 A 3/1976 Sutherland et al.
3,963,121 A 6/1976 Kipp
3,986,319 A * 10/1976 Puskarz ..... B65B 11/004 53/207
4,000,811 A 1/1977 Hardinson et al.
4,004,500 A 1/1977 Wood
D243,508 S 3/1977 Killy
4,010,593 A 3/1977 Graham
4,030,596 A 6/1977 Snyder et al.
4,096,985 A 6/1978 Wood
4,098,050 A * 7/1978 Dietz ..... B65B 21/00 53/448
4,101,069 A 7/1978 Wood
4,149,355 A * 4/1979 Clegg ..... B65B 25/04 53/154
D252,259 S 7/1979 Rinehart
4,195,765 A 4/1980 Roccaforte et al.
4,200,220 A 4/1980 Ganz
4,202,446 A 5/1980 Sutherland
4,214,660 A 7/1980 Hunt, Jr.
4,216,861 A 8/1980 Oliff
4,222,485 A 9/1980 Focke
D261,861 S 11/1981 Carter
D263,204 S 3/1982 Dutcher
4,318,474 A 3/1982 Hasegawa
4,325,482 A 4/1982 Feeser
4,328,893 A 5/1982 Oliff et al.
4,364,509 A 12/1982 Holley, Jr. et al.
4,375,258 A 3/1983 Crayne et al.
D269,068 S 5/1983 Mann et al.
4,394,903 A 7/1983 Bakx

(56) References Cited

U.S. PATENT DOCUMENTS

D270,041 S 8/1983 Vestal
4,396,143 A 8/1983 Killy
4,416,410 A 11/1983 Herrmann
4,417,655 A 11/1983 Forbes, Jr.
4,417,661 A 11/1983 Roccaforte
4,421,232 A 12/1983 Konaka
4,424,901 A 1/1984 Lanier
4,440,340 A 4/1984 Bakx
4,465,180 A 8/1984 Klygis
4,482,090 A 11/1984 Milliens
4,498,581 A 2/1985 Dutcher
4,508,258 A 4/1985 Graser
4,519,182 A 5/1985 Lever et al.
4,523,676 A 6/1985 Barrash
4,566,593 A 1/1986 Muller
4,577,762 A 3/1986 Kuchenbecker
4,582,199 A 4/1986 Schuster
D286,987 S 12/1986 Golan et al.
4,726,471 A 2/1988 Whately et al.
4,735,315 A 4/1988 Oliff et al.
4,742,915 A 5/1988 Ringer
4,747,485 A 5/1988 Chaussadas
4,747,487 A 5/1988 Wood
4,756,139 A * 7/1988 Le Bras ..... B65B 21/242 53/398
4,756,419 A 7/1988 Le Bras
4,784,266 A 11/1988 Chaussadas
4,785,991 A 11/1988 Schuster
4,804,089 A 2/1989 Wilson
4,817,797 A * 4/1989 Hamelin ..... B65D 5/46016 206/427
D303,090 S 8/1989 Armor et al.
4,860,943 A 8/1989 Cooper
4,860,944 A 8/1989 Wonnacott
4,875,585 A 10/1989 Kadleck et al.
4,890,440 A 1/1990 Romagnoli
4,901,849 A 2/1990 Wilson
4,919,266 A 4/1990 McIntosh, Jr. et al.
4,949,845 A 8/1990 Dixon
4,966,324 A 10/1990 Steel
4,972,991 A 11/1990 Schuster
4,974,771 A 12/1990 Lavery
4,981,253 A 1/1991 Quaintenance
5,000,313 A 3/1991 Oliff
5,002,186 A 3/1991 Cooper
5,031,825 A 7/1991 Romagnoli
5,042,660 A 8/1991 Carver
5,060,792 A 10/1991 Oliff
5,067,615 A 11/1991 Davitian
5,094,347 A 3/1992 Schuster
5,101,642 A 4/1992 Alexandrov
5,107,986 A 4/1992 Cooper
5,123,589 A 6/1992 Cote
5,131,588 A 7/1992 Oliff
5,137,211 A 8/1992 Summer et al.
5,170,934 A 12/1992 Lemoine
5,180,100 A 1/1993 Shimizu
D332,915 S 2/1993 Hoell et al.
5,195,676 A 3/1993 LeBras
5,197,656 A 3/1993 Hoell et al.
5,246,112 A 9/1993 Stout et al.
5,277,360 A 1/1994 DeMott
5,279,440 A 1/1994 Fougeres et al.
5,284,292 A 2/1994 Johnson
5,297,673 A 3/1994 Sutherland
5,333,734 A 8/1994 Stout et al.
5,351,878 A 10/1994 Cooper
5,368,194 A 11/1994 Oliff et al.
5,395,043 A 3/1995 Bacques et al.
5,421,458 A 6/1995 Campbell
5,427,242 A 6/1995 Oliff et al.
D360,131 S 7/1995 Tudor
5,443,203 A 8/1995 Sutherland
D364,087 S 11/1995 Farle
5,465,831 A 11/1995 Smith
5,472,090 A 12/1995 Sutherland
5,472,138 A 12/1995 Ingram
5,485,915 A 1/1996 Harris
5,505,372 A 4/1996 Edson et al.
5,518,111 A 5/1996 Stout
5,536,194 A 7/1996 Larsen
5,542,536 A 8/1996 Sutherland
5,551,556 A 9/1996 Sutherland
5,558,212 A 9/1996 Sutherland
5,558,213 A 9/1996 Sutherland
5,595,339 A 1/1997 Correll
5,597,071 A 1/1997 Sutherland
5,609,251 A 3/1997 Harris
5,622,309 A 4/1997 Matsuda et al.
5,664,401 A 9/1997 Portrait et al.
5,664,683 A 9/1997 Brody
5,682,995 A 11/1997 Sutherland
5,690,213 A 11/1997 Matsumura
5,692,614 A 12/1997 Harris
5,704,470 A 1/1998 Sutherland
5,704,542 A 1/1998 Harrelson
5,722,584 A 3/1998 Fujiwara
D393,800 S 4/1998 Harrison
5,765,685 A 6/1998 Roosa
5,775,574 A 7/1998 Whitnell
5,778,630 A 7/1998 Portrait et al.
5,782,343 A 7/1998 Harrelson
5,826,712 A * 10/1998 Aikio ..... B65D 71/70 206/203
5,826,783 A 10/1998 Stout
5,833,118 A 11/1998 Weiss
5,853,088 A 12/1998 Saulas et al.
5,855,318 A 1/1999 Baxter
5,865,312 A 2/1999 Stall
5,873,515 A 2/1999 Dunn et al.
5,875,961 A 3/1999 Stone et al.
5,878,947 A 3/1999 Hoy et al.
5,881,884 A 3/1999 Podosek
5,915,546 A 6/1999 Harrelson
5,921,398 A 7/1999 Carroll
5,924,559 A 7/1999 Carrel et al.
5,931,300 A 8/1999 Sutherland
5,937,620 A 8/1999 Chalendar
5,941,453 A 8/1999 Oliff
5,943,847 A 8/1999 Chalendar
5,947,367 A 9/1999 Miller et al.
5,975,286 A 11/1999 Oliff
6,019,220 A 2/2000 Sutherland
6,021,898 A 2/2000 Sutherland
6,021,899 A 2/2000 Sutherland
6,039,181 A 3/2000 Whiteside
6,085,969 A 7/2000 Burgoyne
6,105,338 A * 8/2000 Kalany ..... B65B 35/405 198/475.1
6,105,854 A 8/2000 Spivey
6,109,438 A 8/2000 Sutherland
6,155,480 A 12/2000 Botsford et al.
6,158,586 A 12/2000 Muller
D436,859 S 1/2001 Botsford et al.
6,176,419 B1 1/2001 Holley, Jr.
6,227,367 B1 5/2001 Harrelson et al.
6,241,083 B1 6/2001 Harrelson
D446,114 S 8/2001 Stephens
6,283,293 B1 9/2001 Lingamfelter
6,289,651 B1 9/2001 Le Bras
6,315,123 B1 11/2001 Ikeda
D454,784 S 3/2002 Oram
6,378,697 B1 4/2002 Sutherland et al.
6,378,765 B1 4/2002 Sutherland
6,386,369 B2 5/2002 Yuhas et al.
6,409,077 B1 6/2002 Telesca et al.
6,435,351 B1 8/2002 Gibb
6,478,219 B1 11/2002 Holley, Jr.
6,550,615 B2 4/2003 Linghamfelter
6,550,616 B2 4/2003 Le Bras
6,578,736 B2 6/2003 Spivey
6,631,803 B2 10/2003 Rhodes et al.
6,688,839 B1 * 2/2004 Hirschek ..... B65B 21/06 198/347.1

(56) References Cited

U.S. PATENT DOCUMENTS 6,715,639 B2 4/2004 Spivey
6,752,262 B1 6/2004 Boriani et al.
6,789,673 B2 9/2004 Lingamfelter
6,811,525 B2 11/2004 Culpepper
6,866,185 B2 3/2005 Harrelson
6,866,186 B2 3/2005 Fogle et al.
6,948,651 B2 9/2005 Ikeda
6,981,631 B2 1/2006 Fogle et al.
6,988,617 B2 1/2006 Gomes et al.
7,000,803 B2 2/2006 Miller
7,007,800 B2 3/2006 Le Bras
7,025,197 B2 4/2006 Sutherland
7,048,113 B2 5/2006 Gomes
7,100,798 B2 9/2006 Spivey
7,159,759 B2 1/2007 Sutherland
7,175,020 B2 2/2007 Sutherland et al.
7,237,674 B2 7/2007 Auclair
7,427,010 B2 9/2008 Sutherland
7,448,492 B2 11/2008 Sutherland
7,644,817 B2 1/2010 Sutherland
7,677,387 B2 3/2010 Brand et al.
7,762,395 B2 7/2010 Sutherland et al.
7,762,397 B2 7/2010 Coltri-Johnson et al.
7,766,219 B2 8/2010 Gomes et al.
D628,882 S 12/2010 Work
7,870,993 B2 1/2011 Walling
7,913,844 B2 3/2011 Spivey, Sr.
D636,663 S 4/2011 Work
7,975,841 B2 * 7/2011 Marco ..... B65D 71/504 206/150
D645,739 S 9/2011 Ross
D646,157 S 10/2011 Work
D655,600 S 3/2012 Work
8,235,201 B2 * 8/2012 Miller ..... B65G 47/088 198/418
D668,540 S 10/2012 Lutzig
8,347,591 B2 1/2013 Coltri-Johnson
8,376,213 B2 2/2013 Brand
8,439,254 B2 5/2013 Smalley
D704,049 S 5/2014 Ridenour
D705,054 S 5/2014 McCarthy
8,800,852 B2 8/2014 Schemmel et al.
D715,638 S 10/2014 Wollschleger
8,875,869 B1 * 11/2014 Burchell ..... B65G 47/088 198/418.5
D729,060 S 5/2015 Trombetta
D747,966 S 1/2016 McClaughry
D748,975 S 2/2016 McClaughry
D760,072 S 6/2016 Lutz
9,392,888 B2 7/2016 Spivey, Sr.
9,415,915 B2 8/2016 Spivey, Sr. et al.
9,434,520 B2 9/2016 Bates
9,452,874 B2 9/2016 Harrelson
D781,142 S 3/2017 Trujillo
D793,224 S 8/2017 Sagardoy Muniesa
9,845,182 B2 12/2017 Baldino
D811,218 S 2/2018 Baldino
2002/0070139 A1 6/2002 Bates
2002/0088820 A1 7/2002 Spivey
2002/0088821 A1 7/2002 Spivey et al.
2002/0185527 A1 12/2002 Bates
2003/0000182 A1 1/2003 Portrait et al.
2003/0132130 A1 7/2003 Bras
2003/0141353 A1 7/2003 Wilson
2003/0192905 A1 10/2003 Spivey
2004/0000582 A1 1/2004 Sutherland
2004/0011674 A1 1/2004 Theelen
2004/0060972 A1 4/2004 Harrelson
2004/0069659 A1 4/2004 Sutherland
2004/0089671 A1 5/2004 Miller
2004/0099542 A1 5/2004 Sutherland
2004/0099558 A1 5/2004 Oliff et al.
2004/0164133 A1 8/2004 Harrelson
2004/0188277 A1 9/2004 Auclair
2004/0188301 A1 9/2004 Gomes
2004/0232034 A1 11/2004 Lebras
2004/0243277 A1 12/2004 Bonnain et al.
2004/0254666 A1 12/2004 Bonnain et al.
2005/0001020 A1 1/2005 Gamier
2005/0087592 A1 4/2005 Schuster
2005/0103652 A1 5/2005 Wilkins
2005/0167290 A1 8/2005 Sutherland
2005/0178687 A1 8/2005 Spivey, Sr.
2005/0178791 A1 8/2005 Miller
2005/0194430 A1 9/2005 Auclair et al.
2005/0263574 A1 12/2005 Schuster
2006/0000881 A1 1/2006 Sutherland
2006/0108406 A1 5/2006 Stewart et al.
2006/0157545 A1 7/2006 Auclair
2006/0191811 A1 8/2006 Fogle et al.
2006/0231604 A1 10/2006 DeBusk
2006/0254942 A1 11/2006 Cargile, Jr.
2006/0255108 A1 11/2006 Shmagin
2006/0261140 A1 11/2006 Holley, Jr.
2007/0017829 A1 1/2007 Sutherland
2007/0131748 A1 6/2007 Brand
2007/0158226 A1 7/2007 Coltri-Johnson et al.
2007/0227927 A1 10/2007 Coltri-Johnson
2007/0241017 A1 10/2007 Sutherland et al.
2008/0237320 A1 10/2008 Philips
2008/0257943 A1 10/2008 Blin
2010/0044420 A1 2/2010 Brand et al.
2010/0051494 A1 3/2010 DeBusk
2010/0072267 A1 3/2010 May et al.
2011/0036902 A1 2/2011 Smalley
2011/0131926 A1 6/2011 Coltri-Johnson
2011/0284624 A1 11/2011 DeBusk et al.
2012/0091190 A1 4/2012 Smalley et al.
2013/0213991 A1 8/2013 Harrelson
2013/0264379 A1 10/2013 Schemmel et al.
2014/0284237 A1 * 9/2014 Gosset ..... B65G 57/20 206/427
2014/0311091 A1 * 10/2014 Moncrief ..... B65B 35/405 53/410
2015/0251828 A1 9/2015 Spivey, Sr. et al.
2016/0167829 A1 6/2016 Spivey, Sr. et al.
2016/0194106 A1 7/2016 Walling
2016/0231604 A1 8/2016 Lin et al.
2016/0244202 A1 8/2016 Alexander et al.
2016/0272393 A1 9/2016 Kastanek et al.

FOREIGN PATENT DOCUMENTS

CA 2 542 350 5/2005
DE 1 192 099 4/1965
DE 2 323 589 11/1974
DE 75 10 538 8/1975
DE 76 06 493 6/1976
DE 29 33 022 2/1980
DE 30 07 769 9/1981
DE 81 35 176 5/1982
DE G 85 14 718.4 6/1985
DE G 86 29 664.7 5/1987
DE 36 12 594 10/1987
DE 91 04 905.9 6/1991
DE 40 23 043 12/1991
DE 92 03 858.1 5/1992
DE 94 12 885 10/1994
DE 94 13 813 10/1994
DE 295 19 931 2/1996
DE 296 02 010 3/1996
DE 299 09 008 9/1999
DE 29913585 10/1999
DE 694 21 620 4/2000
EP 0 235 852 9/1987
EP 0 323 596 7/1988
EP 0 341 089 A2 11/1989
EP 0 342 088 11/1989
EP 0 459 658 12/1991
EP 0 475 147 3/1992
EP 0 509 749 10/1992
EP 0 520 411 12/1992
EP 0 752 370 1/1997
EP 0 849 189 6/1998

(56) References Cited

FOREIGN PATENT DOCUMENTS

| | | | | |
|---|---|---|---|---|
| EP | 0 899 200 | A1 | 3/1999 | |
| EP | 1 060 998 | | 12/2000 | |
| EP | 1 262 417 | | 12/2002 | |
| EP | 1 334 033 | B1 | 1/2006 | |
| EP | 1 612 157 | A2 | 1/2006 | |
| EP | 1 518 792 | B1 | 5/2011 | |
| EP | 2 557 049 | B1 | 5/2016 | |
| FR | 2 456 039 | A1 | 12/1980 | |
| FR | 2 549 010 | | 1/1985 | |
| FR | 2 581 970 | | 11/1986 | |
| FR | 2 698 074 | | 5/1994 | |
| JP | 41-18199 | | 10/1941 | |
| JP | 5-112373 | | 5/1993 | |
| JP | 9-507821 | | 8/1997 | |
| JP | 2003-252323 | | 9/2003 | |
| KR | 10-2009-0079640 | A | 7/2009 | |
| WO | WO 88/09750 | | 12/1988 | |
| WO | WO 89/12008 | A1 | 12/1989 | |
| WO | WO 95/01284 | | 1/1995 | |
| WO | WO 95/25668 | | 9/1995 | |
| WO | WO 96/14253 | | 5/1996 | |
| WO | WO 96/29260 | | 9/1996 | |
| WO | WO 97/21607 | | 6/1997 | |
| WO | WO 97/27124 | | 7/1997 | |
| WO | WO 98/31593 | | 7/1998 | |
| WO | WO 98/38099 | | 9/1998 | |
| WO | WO 99/64301 | | 12/1999 | |
| WO | WO 00/23334 | | 4/2000 | |
| WO | WO 00/71428 | | 11/2000 | |
| WO | WO 00/78634 | | 12/2000 | |
| WO | WO 01/28871 | | 4/2001 | |
| WO | WO 02/04302 | | 1/2002 | |
| WO | WO 02/30785 | | 4/2002 | |
| WO | WO 02/085739 | | 10/2002 | |
| WO | WO-02085742 | A1 * | 10/2002 | ..... B65D 71/00 |
| WO | WO 02/102208 | | 12/2002 | |
| WO | WO 03/008292 | | 1/2003 | |
| WO | WO 03/082686 | | 10/2003 | |
| WO | WO 2004/043790 | | 5/2004 | |
| WO | WO 2004/087507 | | 10/2004 | |
| WO | WO 2005/042370 | | 5/2005 | |
| WO | WO 2005/092735 | | 10/2005 | |
| WO | WO 2007/019000 | | 2/2007 | |
| WO | WO 2007/126977 | | 11/2007 | |
| WO | WO 2009/015320 | | 1/2009 | |
| WO | WO 2013/170123 | A1 | 11/2013 | |
| WO | WO 2014-052514 | A2 | 4/2014 | |
| WO | WO 2014/172409 | | 10/2014 | |

OTHER PUBLICATIONS

Supplementary European Search Report for EP 15 79 5428 dated Dec. 15, 2017.
International Search Report and Written Opinion for PCT/US2014/039351 dated Oct. 16, 2014.
International Search Report and Written Opinion for PCT/US2015/0131904 dated Aug. 28, 2015.
Office Action for U.S. Appl. No. 14/286,343 dated Jun. 10, 2015.
Response to Restriction Requirement for U.S. Appl. No. 14/286,343 dated Jul. 27, 2015.
Office Action for U.S. Appl. No. 14/286,343 dated Oct. 7, 2015.
Amendment A and Response to Office Action for U.S. Appl. No. 14/286,343 dated Jan. 7, 2016.
Office Action for U.S. Appl. No. 14/286,343 dated Feb. 4, 2016.
Amendment B and Response to Final Office Action for U.S. Appl. No. 14/286,343 dated Apr. 6, 2016.
Notice of Allowance and Fee(s) Due for U.S. Appl. No. 14/286,343 dated Apr. 29, 2016.
Supplementary European Search Report for EP 14 80 0400 dated Oct. 6, 2016.
Office Action for U.S. Appl. No. 15/148,189 dated Oct. 18, 2016.
Response to Restriction Requirement for U.S. Appl. No. 15/148,189 dated Nov. 18, 2016.
Office Action for U.S. Appl. No. 15/148,189 dated Jan. 30, 2017.
Amendment A and Response to Office Action for U.S. Appl. No. 15/148,189 dated Apr. 25, 2017.
Issue Fee Transmittal for U.S. Appl. No. 14/286,343 dated Jul. 11, 2016.
Issue Notification for U.S. Appl. No. 14/286,343 dated Jul. 27, 2017.
Office Action for U.S. Appl. No. 14/718,361 dated Aug. 17, 2016.
Response to Restriction Requirement for U.S. Appl. No. 14/718,361 dated Sep. 23, 2016.
Office Action for U.S. Appl. No. 14/718,361 dated Oct. 26, 2016.
Amendment A and Response to Office Action for U.S. Appl. No. 14/718,361 dated Jan. 26, 2017.
Office Action for U.S. Appl. No. 14/718,361 dated Apr. 24, 2017.
Office Action for Chinese Application No. 201580027315.8 dated Jan. 4, 2019, with brief description in English.

* cited by examiner

ARRANGEMENT OF CONTAINERS IN A CARTON

CROSS-REFERENCE TO RELATED APPLICATIONS

This application is a continuation-in-part of U.S. patent application Ser. No. 15/148,189, filed May 6, 2016, which claims the benefit of U.S. Provisional Patent Application No. 62/179,446, filed May 7, 2015. This application is a continuation-in-part of U.S. patent application Ser. No. 14/718,361, filed May 21, 2015, which claims the benefit of U.S. Provisional Patent Application No. 61/997,147, filed May 22, 2014. U.S. patent application Ser. No. 14/718,361 is a continuation-in-part of U.S. patent application Ser. No. 14/286,343, filed May 23, 2014, which claims the benefit of 61/855,819, filed on May 24, 2013, and U.S. Provisional Patent Application No. 61/956,388, filed Jun. 7, 2013. This application is a continuation-in-part of U.S. patent application Ser. No. 15/097,618, filed Apr. 13, 2016, which is a divisional of U.S. patent application Ser. No. 14/286,343, filed May 23, 2014, which claims the benefit of 61/855,819, filed on May 24, 2013, and U.S. Provisional Patent Application No. 61/956,388, filed Jun. 7, 2013.

INCORPORATION BY REFERENCE

The disclosures of U.S. patent application Ser. No. 15/148,189, which was filed May 6, 2016, U.S. patent application Ser. No. 15/097,618, which was filed Apr. 13, 2016, U.S. patent application Ser. No. 14/718,361, which was filed May 21, 2015, U.S. patent application Ser. No. 14/286,343, which was filed May 23, 2014, U.S. Provisional Patent Application No. 62/179,446, which was filed May 7, 2015, U.S. Provisional Patent Application No. 61/997,147, which was filed May 22, 2014, U.S. Provisional Patent Application No. 61/956,388, which was filed Jun. 7, 2013, and U.S. Provisional Patent Application No. 61/855,819, which was filed on May 24, 2013, are hereby incorporated by reference for all purposes as if presented herein in their entirety.

BACKGROUND OF THE DISCLOSURE

The present disclosure generally relates to arrangements of containers contained in cartons, trays, and/or other constructs. More specifically, the present disclosure relates to nested arrangements of containers.

SUMMARY OF THE DISCLOSURE

In general, one aspect of the disclosure is generally directed to a package comprising a carton and an arrangement of containers. The carton can comprise a plurality of panels extending at least partially around an interior of the carton. The plurality of panels can comprise at least a first panel and a second panel disposed opposite to one another. The arrangement can comprise a number of rows of containers disposed at least partially in the interior of the carton. The number of rows in the arrangement can comprise a plurality of rows comprising at least a first row extending along the first panel and a second row extending along the second panel. Each container in the arrangement can comprise a diameter. The arrangement can comprise a load width extending from an outermost edge of the first row to an outermost edge of the second row, the load width can be less than the number of rows multiplied by a first difference determined by subtracting approximately an eighth of an inch from the diameter of the containers in the arrangement, and the load width can be greater than the number of rows multiplied by a second difference determined by subtracting approximately a half of an inch from the diameter of the containers in the arrangement.

In another aspect, the disclosure is generally directed to a method comprising obtaining a carton comprising a plurality of panels extending at least partially around an interior of the carton. The plurality of panels can comprise at least a first panel and a second panel disposed opposite to one another. The method further can comprise obtaining a plurality of containers, each container in the plurality of containers comprising a diameter. The method also can comprise forming an arrangement by positioning the containers into a number of rows, the number of rows in the arrangement comprising a plurality of rows. The positioning the containers into the number of rows can comprise forming at least a first row and a second row. The forming the arrangement can comprise forming a load width of the arrangement, wherein the load width can extend from an outermost edge of the first row to an outermost edge of the second row. The load width can be less than the number of rows multiplied by a first difference determined by subtracting approximately an eighth of an inch from the diameter of the containers in the arrangement, and the load width can be greater than the number of rows multiplied by a second difference determined by subtracting approximately a half of an inch from the diameter of the containers in the arrangement. Additionally, the method can comprise loading the arrangement at least partially into the interior of the carton so that the first row extends along the first panel and the second row extends along the second panel.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to arrangements of articles such as containers, bottles, cans, etc. that can be contained in cartons. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles or aluminum cans) as disposed in certain nested arrangements that can be disposed within carton embodiments. In this specification, the terms "inner," "outer," "lower," "bottom," "upper," and "top" indicate orientations determined in relation to fully erected and upright cartons.

Figure 1B:
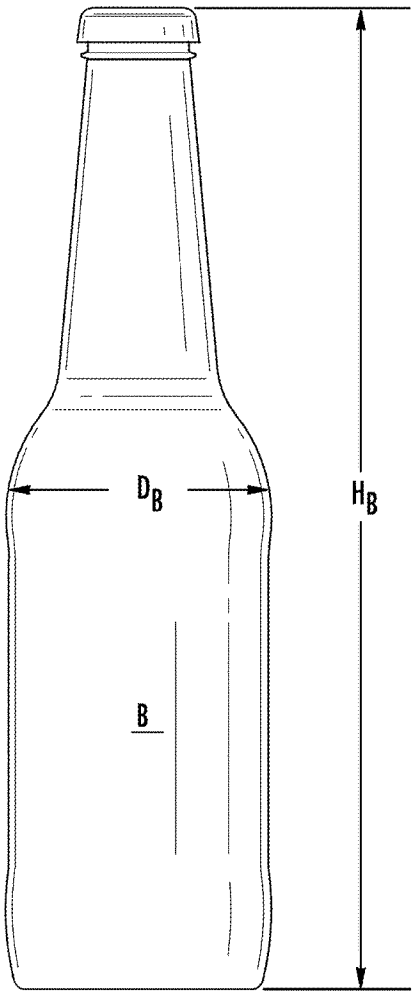
FIGS. 1A and 1B are side views of containers according to a first exemplary embodiment of the present disclosure.
Figure 1A:
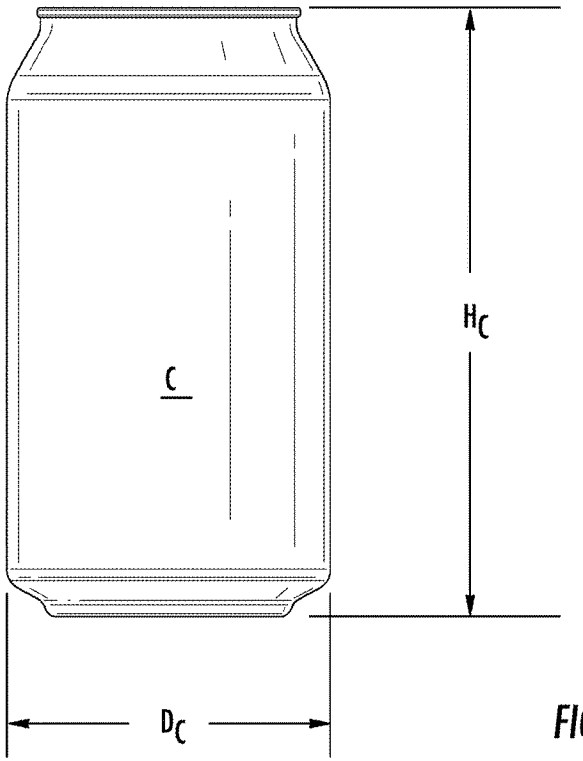

FIGS. 1A and 1B illustrate exemplary containers (e.g., a can C and a bottle B, respectively) that can be arranged according to aspects of the disclosure. In one embodiment, the can C can be generally cylindrical and the bottle B can have a wide bottom portion and a narrow upper portion or neck. In the illustrated embodiment, each of the containers C, B can have a respective height $H_C$, $H_B$ and a respective characteristic dimension or diameter $D_C$, $D_B$. In one embodiment, the characteristic diameters $D_C$, $D_B$ are the largest diameters for the respective containers C, B. In an exemplary embodiment, the diameters $D_C$, $D_B$ are in the range of approximately 1 inch to 4 inches or of approximately 2 inches to 3 inches (e.g., the diameter $D_C$ can be approximately 2.6 inches and the diameter $D_B$ can be approximately 2.4 inches). Alternatively, the containers C, B can have any suitable diameter and any suitable height. The embodiments discussed below generally reference containers C (e.g., the can C of FIG. 1A); however, the containers described below generally can be cans C, bottles B, and/or any other suitable container.

Figures 2A, 2B, 2C:
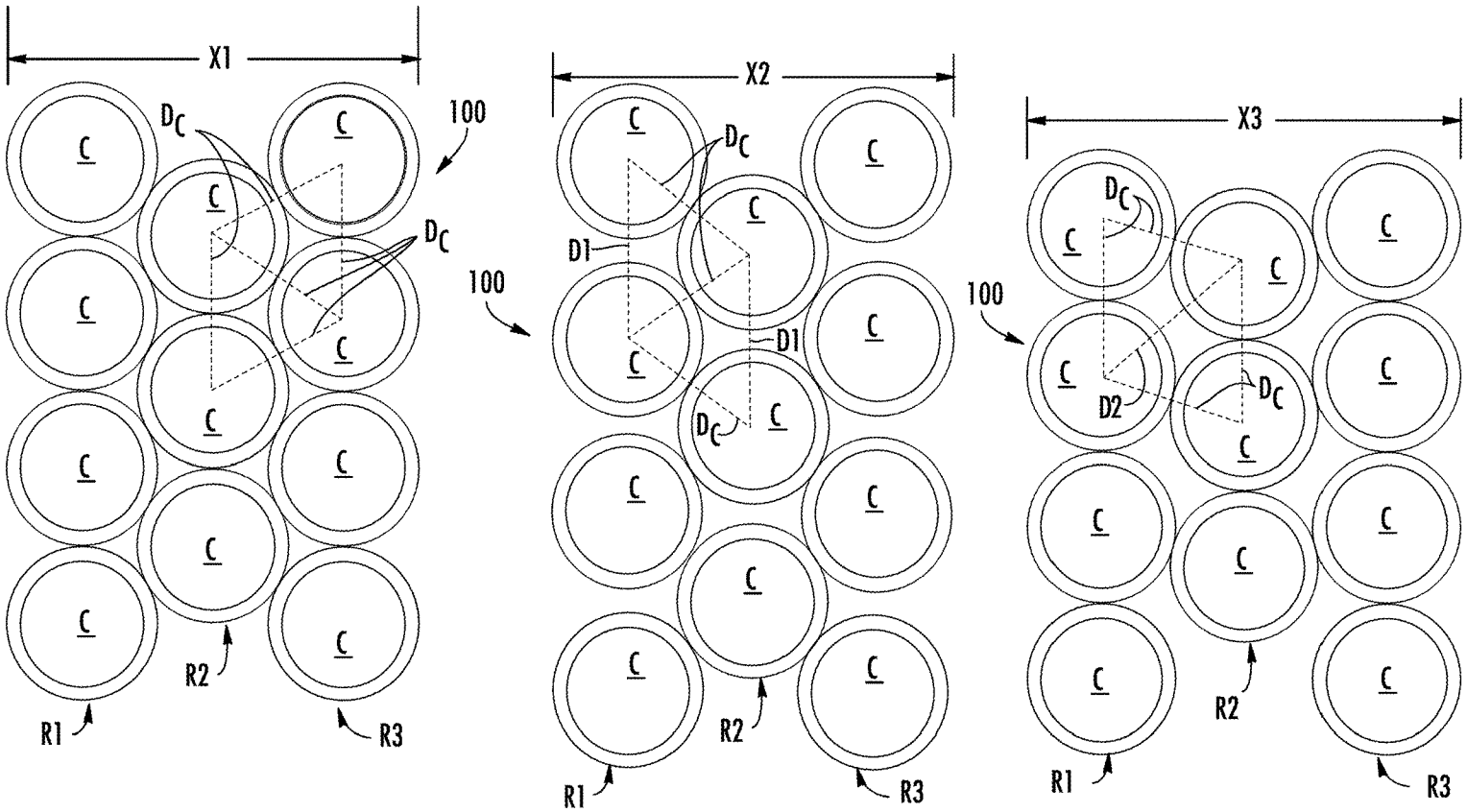
FIGS. 2A-2C are schematic top views of an arrangement of the containers of FIG. 1A according to the first exemplary embodiment of the present disclosure.
Figures 3A, 3B, 3C:
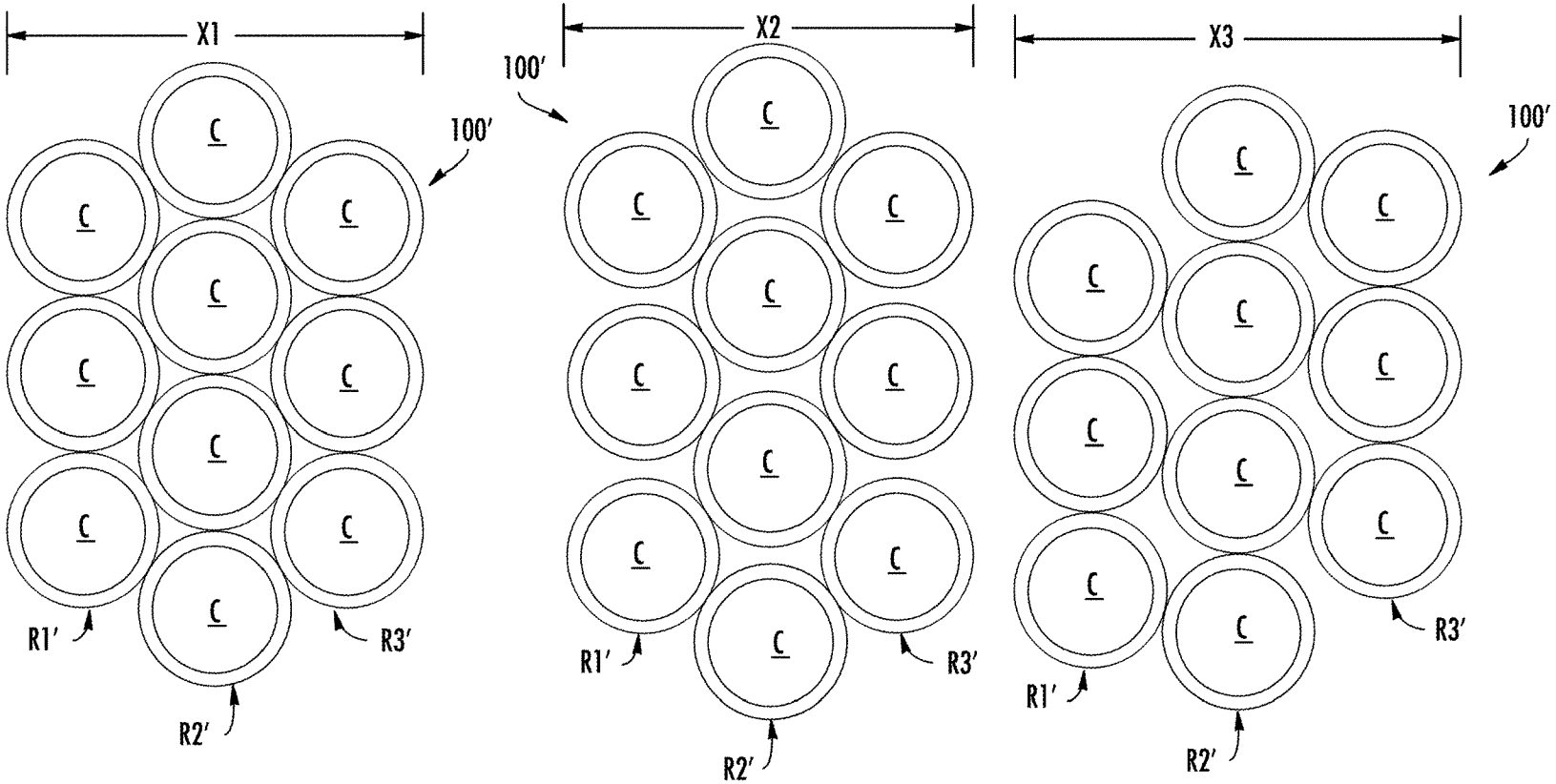
FIGS. 3A-3C are schematic top views of an alternative arrangement of the containers.

As shown for example in FIGS. 2A-3C, the containers C can be disposed in a nested arrangement. In the illustrated embodiment, the containers C can be positioned in a single layer in a "nested" (e.g., an "internal" or "inverted" nested) arrangement 100 having two outer rows R1, R2 of four containers per row and an inner row R2 of three containers (e.g., in a 4×3×4 arrangement) as shown in FIGS. 2A-2C. Similarly, the containers C can be disposed in a single layer in an external (or "fully") nested arrangement 100' having two outer rows R1', R3' with three containers per row and an inner row R2' with four containers (e.g., in a 3×4×3 arrangement) as shown in FIGS. 3A-3C. In the illustrated embodiment, the internal nested arrangement 100 of FIGS. 2A-2B can have one more container in the outermost rows R1, R3 than the inner row R2. In general, an internal nesting arrangement can have one or more interior rows of containers C that are generally shorter than the outer rows of containers. For example, the outer rows R1, R3 could have more containers each than one or more inner row(s) R2 respectively nested with the outer rows. Exemplary variations could include outer row(s) R1, R3 having eight containers each and an inner row R2 having seven containers, outer rows R1, R3 having five containers each and an inner row R2 having four containers, etc.

In the illustrated embodiment, the external nested arrangement 100' of FIGS. 3A-3C can have one fewer container in each of the outermost rows R1', R3' than the inner row R2'. In general, an external nesting arrangement can have outermost rows of containers C that are generally shorter than one or more interior rows of containers. For example, the outer rows R1', R3' could have fewer containers each than one or more inner row(s) R2' respectively nested with the outer rows. Exemplary variations could include outer row(s) R1', R3' having seven containers each and an inner row R2' having eight containers, outer rows R1', R3' having four containers each and an inner row R2' having five containers, etc. Other nested (e.g., fully nested arrangements, internal nested arrangements, and/or other arrangements) or non-nested arrangements of the containers including bottles B or cans C could be provided without departing from the disclosure. Alternative nested arrangements can include different numbers of rows with some or all of the rows being nested with adjacent rows (e.g., 8×7×8×7×8, 5×6×5×6, 3×4×3×4×3×4×3, 4×4×3×4, 5×6×6×5, and 8×7×7×8 arrangements).

As shown in FIGS. 2A-2C, the containers C of the arrangement 100 can be nested so that the arrangement has different widths (e.g., the arrangement can have widths X1, X2, X3 or other suitable widths). As shown in FIG. 2A, the containers C can be positioned in the arrangement 100 so that each of the containers C is in contact with the respectively adjacent containers C. In one embodiment, the distance between the centers of each container C can be spaced from the centers of the respectively adjacent containers by approximately the diameter $D_C$ of the containers C. Accordingly, in FIG. 2A, the spacing between the centers of each set of three adjacent containers C generally forms an equilateral triangle.

Alternatively, as shown by way of example in FIG. 2B, the containers C can be disposed in the arrangement 100 so that each container C is spaced apart from the respectively adjacent container(s) C in the same row while being in contact with the respectively adjacent container(s) C in the respectfully adjacent row(s). In one embodiment, the spacing of the containers in each row can allow closer nesting between containers in adjacent rows (e.g., the containers C in the inner row R2 can nest farther between the respective containers C in the outer rows R1, R3). Accordingly, the width X2 of the arrangement 100 in FIG. 2B can be less than the width X1 of the arrangement 100 shown in FIG. 2A. As shown in FIG. 2B, the center of each container C is spaced from the center of a contacting container C in an adjacent row by the diameter $D_C$ of the containers, and the center of each container C is spaced from the center of each adjacent container in the same row by a distance D1 that is greater than the distance $D_C$. Accordingly, in FIG. 2B the spacing between the centers of each set of three adjacent containers C generally forms an isosceles triangle (e.g., two sides having a length of the diameter $D_C$ and one side having a length D1).

In another alternative, the containers C can be disposed in the arrangement 100 so that the containers C in each row R1, R2, R3 are less tightly nested with the containers C in the respectfully adjacent rows as shown by way of example in FIG. 2C. For example, the containers C in the inner row R2 can be shifted with respect to the outer rows R1, R3 with respect to the relative positions of the containers C in FIG. 2A. In the illustrated embodiment, the looser nesting of the containers C in FIG. 2C can result in the arrangement 100 have a width X3 that is wider than the widths X1, X2 of FIGS. 2A and 2B. Similarly to FIG. 2B, the spacing between the centers of each set of three adjacent containers C generally forms an isosceles triangle wherein two sides having a length of the diameter $D_C$ and one side having a length D2. The distance D2 is greater than the diameter $D_C$ in the illustrated embodiment.

The containers C are nested in the arrangement 100' in a similar manner in FIGS. 3A-3C as the respective FIGS. 2A-2C. However, in contrast to the nesting described in relation to FIG. 2C, the containers C in the outer rows R1', R3' in FIG. 3C are shifted in opposite directions with respect to the inner row R2'. The containers C could be positioned with any suitable degree of nesting in the arrangements 100, 100' and/or other arrangements without departing from the disclosure. For example, the containers C could be disposed in either arrangement 100, 100' with uneven spacing and/or shifting. In one embodiment, some the containers in an arrangement could be spaced similarly to the variations shown in FIGS. 2B and 3B and other containers in the arrangement could be shifted similarly to the variations shown in FIGS. 2C and 3C.

In the illustrated embodiment, the widths X1, X2, X3 are less than 3 times the diameter $D_C$ of the containers for the arrangements 100, 100' having three rows R1, R2, R3. More generally, an arrangement having a number of rows R (e.g., R equals 3 in FIG. 2A) can have a load width X (e.g., as measured from the outermost edge of the outer row R1 or R1' to the outermost edge of the outer row R3 or R3' as shown in FIGS. 2A-3C) that is less than the number of rows R times the diameter $D_C$ according to the expression:

$$R*D_C>X \tag{1}$$

In a particular embodiment, the load width X of the arrangement in inches can be less than the difference found by subtracting a subtrahend of an eighth of an inch from the diameter $D_C$ in inches and then multiplying that difference by the number of rows R as shown in the expression:

$$R*\left(D_C-\frac{1''}{8}\right)>X \tag{2}$$

In a further particular embodiment, the load width X in inches could also be greater than the difference resulting from subtracting a subtrahend of a half of an inch from the diameter $D_C$ in inches and then multiplying the difference by the number of rows R as shown by the expression:

$$R*\left(D_C-\frac{1''}{8}\right)>X>R*\left(D_C-\frac{1''}{2}\right) \tag{3}$$

The arrangements 100, 100' could have other load widths without departing from the disclosure. For example, the first subtrahend of an eighth of an inch in expressions 2 and 3 and the second subtrahend of a half an inch in expression three could be any suitable number.

In an exemplary embodiment, the containers in the arrangement 100 or 100' could be cans C having a diameter $D_C$ of approximately 2.6 inches. Accordingly, the load width X of the arrangements 100, 100' could be less than approximately 7.4 inches and could be more than approximately 6.3 inches according to expression 3 in the exemplary embodiment. In another example, twenty three of the same cans C could be disposed in a 5×4×5×4×5 nested arrangement wherein the load width X of the arrangement can be less than approximately 12.4 inches and can be more than approximately 10.5 inches according to expression 3. In another example, the containers in the arrangement 100 or 100' could be bottles B having a diameter $D_B$ of approximately 2.4 inches. Accordingly, the load width X of the arrangement 100, 100' could be less than approximately 6.8 inches and could be more than approximately 5.7 inches according to expression 3. Other examples are within the scope of the disclosure.

Figure 5:
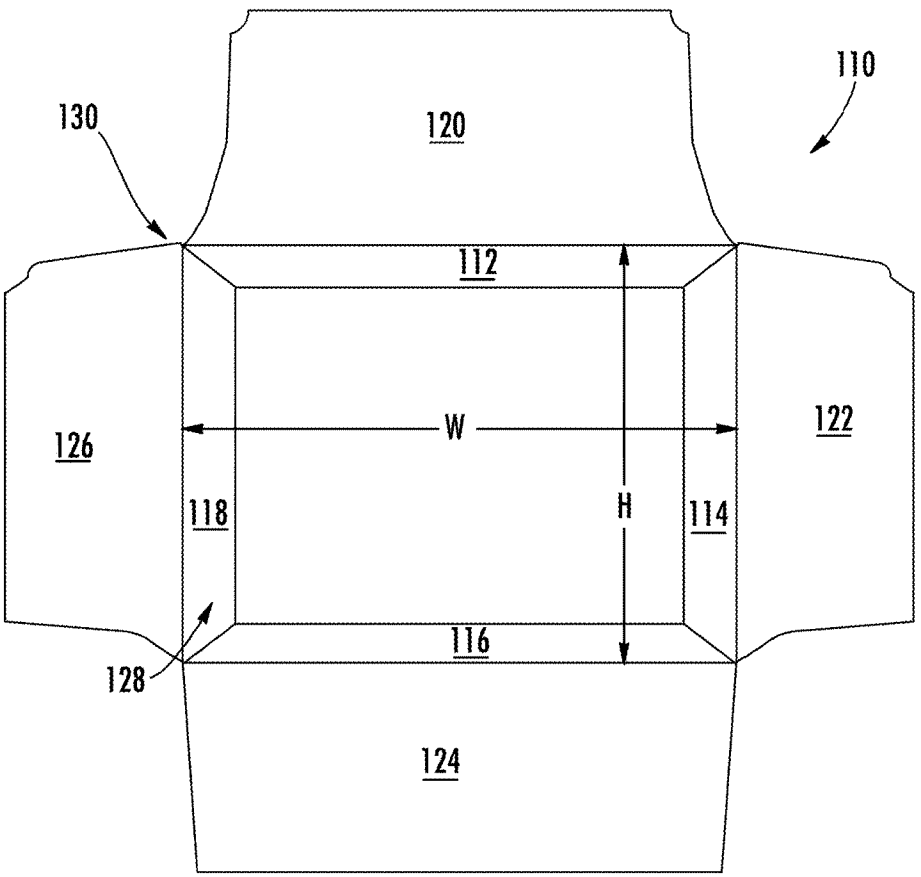
FIG. 5 is an end view of an open-ended carton for holding the arrangement of containers of FIG. 4.

In the illustrated embodiment, the containers C in the arrangement 100 can be disposed in the interior 128 of a carton 110 as shown in FIGS. 6-9. As shown in FIG. 5, the carton 100 can include a first panel 112, a second panel 114, a third panel 116, and a fourth panel 118. The panels 112, 114, 116, 118 can extend around the interior 128 of the carton 110 and can be respectively foldably connected to one another along respective fold lines as shown in FIGS. 5-9. In one embodiment, the carton 110 can include end flaps respectively foldably connected to the panels 112, 114, 116, 118 at each end 130, 132 of the carton. As shown in FIG. 5, the carton 110 can include at one end 130 a first end flap 120 foldably connected to the first panel 112, a second end flap 122 foldably connected to the second panel 114, a third end flap 124 foldably connected to the third panel 116, and a fourth end flap 126 foldably connected to the fourth panel 118. The opposing end 132 of the carton 110 can include similar or identical end flaps (not shown). The carton 110 could be any suitable carton for holding the containers in one of the arrangements 100, 100' or in another suitable arrangement, including but not limited to the cartons described in the incorporated-by-reference U.S. patent application Ser. Nos. 15/148,189, 15/097,618, 14/718,361, and 14/286,343 and U.S. Provisional Patent Application Nos. 62/179,446, 61/997,147, 61/956,388, and 61/855,819.

Figure 4:
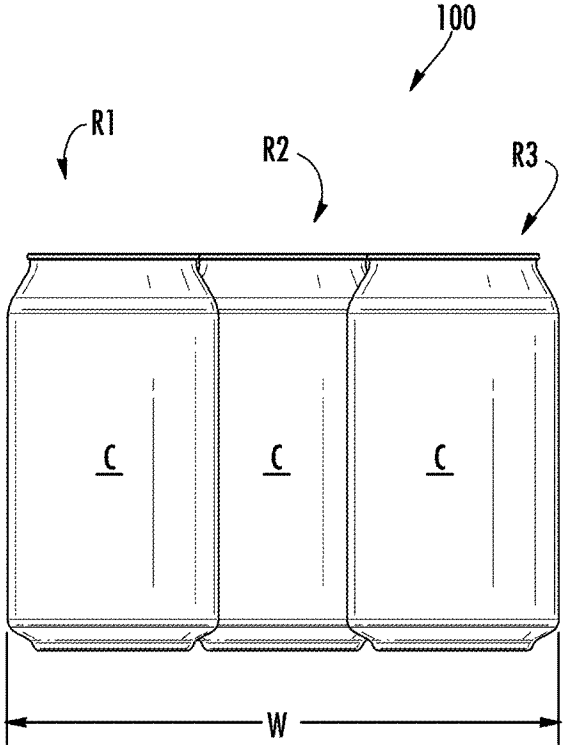
FIG. 4 is an end view of the arrangement of containers of FIG. 2A.

As shown in FIG. 5, the second and fourth panels 114, 118 can be disposed opposite to one another and can be spaced apart by an inner width W, and the first and third panels 112 can be disposed opposite to one another and can be spaced apart by an inner height H. In the illustrated embodiment, the inner height H of the carton 110 can be similar to or slightly greater than the height $H_C$ of the containers C (FIG. 1A). Also, as shown in FIGS. 4 and 5, the inner width W of the carton 110 can be the same as or similar to the load width X of the arrangement 100 (e.g., according to the expression 3). In one embodiment, the containers C could be nested in the arrangement 100 as shown in FIG. 2A having a load width X1.

Figure 6:
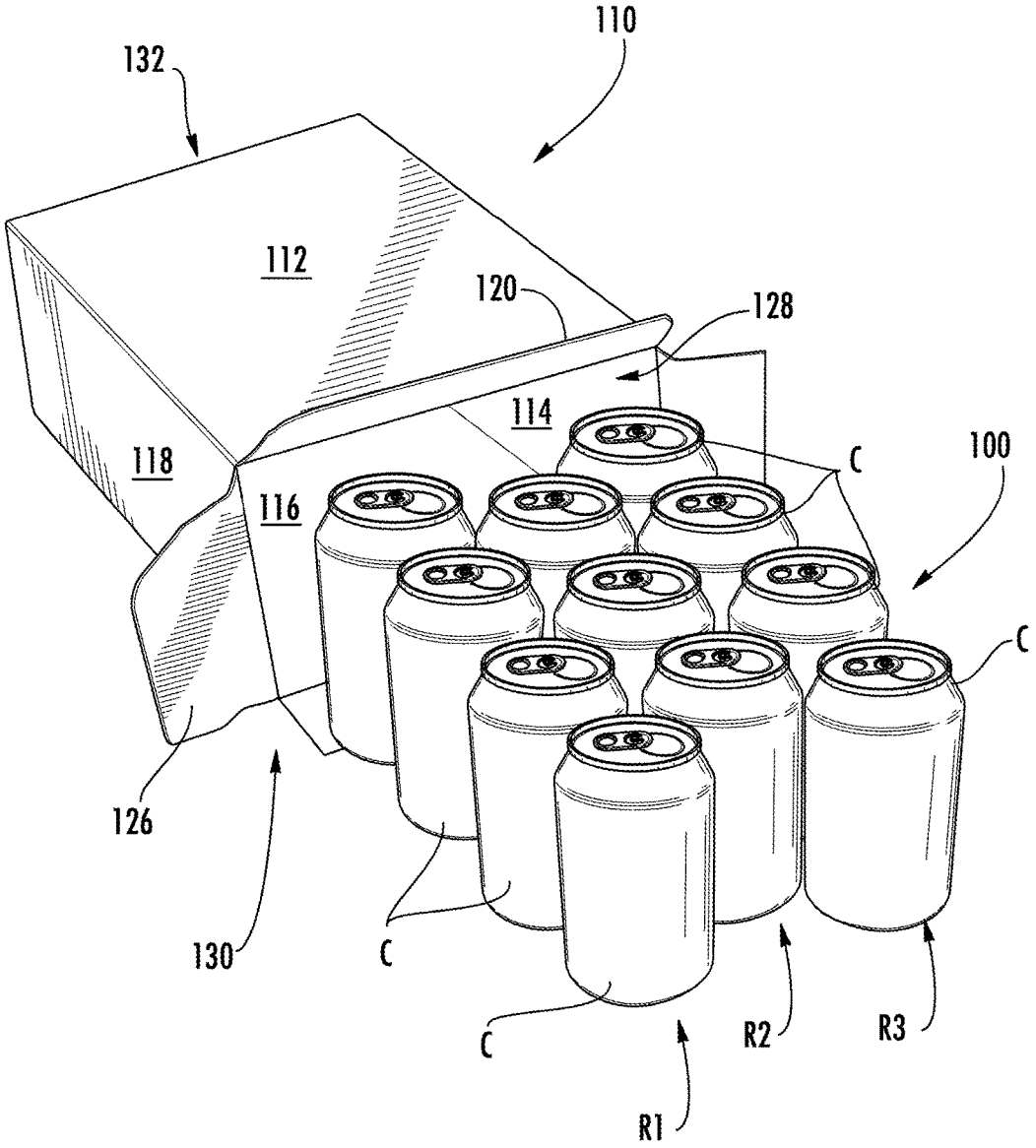
FIGS. 6 and 7 are perspective views showing the loading of the arrangement of containers of FIG. 4 into the open-ended carton of FIG. 5.
Figure 7:
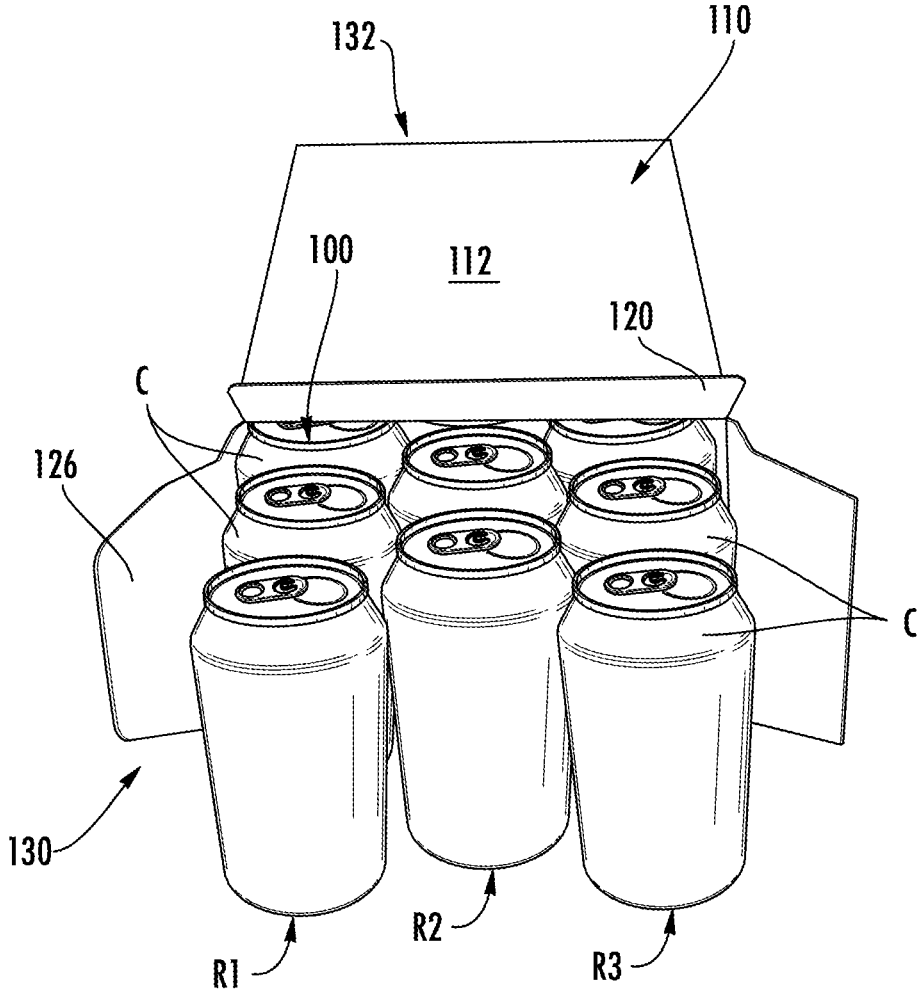
Figure 8:
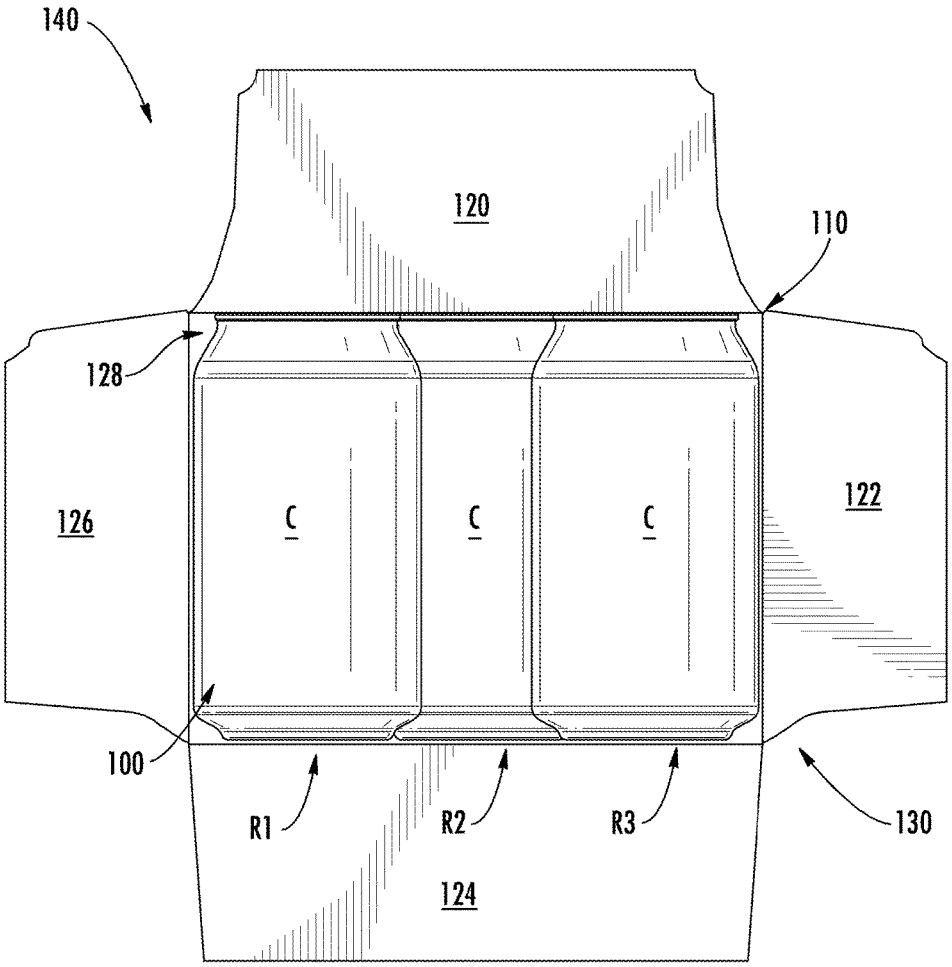
FIG. 8 is an end view of the open-ended carton of FIG. 5 loaded with the containers according to the first exemplary embodiment of the present disclosure.

As shown in FIGS. 6-8, the arrangement 100 can be aligned with the end 130 of the carton 110 and inserted through the end 130 into the interior 128 of the carton so that the containers C are disposed in the interior 128 in the arrangement 100. Alternatively, the arrangement 100' or another suitable arrangement having any suitable load width X (e.g., as determined by the expression 3) could be inserted into the carton 110.

Figure 9:
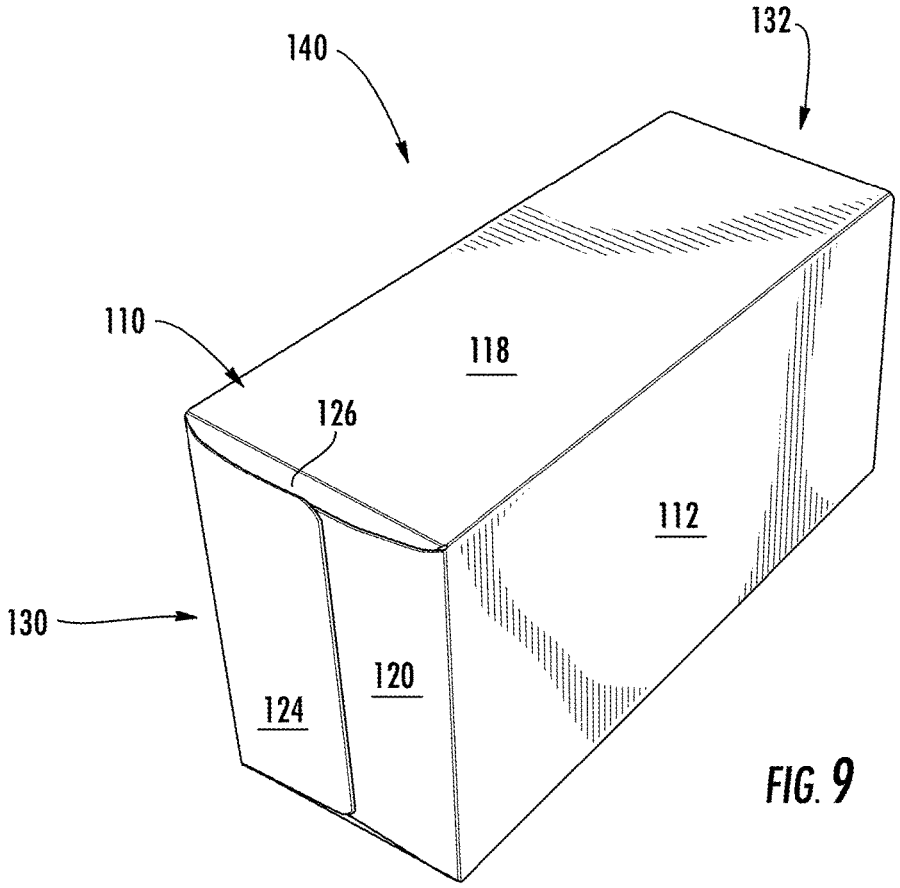
FIG. 9 is a perspective view of the erected carton with closed ends according to the first exemplary embodiment of the present disclosure.

As shown in FIG. 9, the end 130 of the carton 110 can be closed by overlapping the end flaps 120, 122, 124, 126 with respect to one another over the end 130. For example, the end flaps 122, 126 can be folded over the open end of the carton, and the end flaps 120, 124 can be folded over the end and the end flaps 122, 126. The end flaps 120, 124 can overlap the end flaps 122, 126 and/or one another at the closed end 130. In one embodiment, the end flaps 120, 122, 124, 126 can be at least partially glued or otherwise secured to one another at the closed end 130. The opposing end 132 can be closed in a similar or the same manner as the end 130.

In the illustrated embodiment, the combination of the containers C held in the carton 110 forms a package 140 (FIGS. 8 and 9). The containers C could be otherwise loaded into the carton and/or the ends 130, 132 of the carton 110 could be otherwise closed without departing from the disclosure. For example, the arrangement 100 could be loaded into the interior 128 before or after either of the ends 130, 132 is closed. In addition, the containers C could be arranged in the arrangement 100 before, during, or after loading the containers into the interior.

In one embodiment, the rows R1, R2, R3 of the arrangement 100 could be considered to include a first row extending along a first panel (e.g., outer row R1 adjacent the panel 118), a second row extending along a second panel (e.g., the outer row R3 adjacent the panel 114), and a third row nested with the first and second rows (e.g., the inner row R2 nested with the outer rows R1, R3). The outer row R1 can have at least one more container C than the inner row R2, and the inner row R2 can be spaced from the panel 118 by at least the outer row R1. Additionally, the outer row R3 can have at least one more container C than the inner row R2, the outer row R3 can be spaced from the outer row R1 by at least the inner row R2, and the inner row R2 can be spaced from the panel 114 by at least the outer row R3. In one embodiment, the rows R1', R2', R3' of the arrangement 100' can be similarly or identically arranged.

Since, in the illustrated embodiment, the inner row R2 has one fewer container C than the outer rows R1, R3 in the arrangement 100, the containers C at the ends of the inner row R2 are spaced apart from the closed ends 130, 132 of the carton 110. In one embodiment, the containers C at the ends of the outer rows R1, R3 can be disposed against or adjacent to the closed ends 130, 132. With respect to the arrangement 100', the containers C at the ends of the outer rows R1', R3' can be spaced from the closed ends 130, 132 in the carton 110 since the outer rows have one fewer container C than the inner row R2'. The containers C at the ends of the inner row R2' can be disposed in engagement with or adjacent to the closed ends 130, 132 in one embodiment. Any or all of the rows R1, R2, R3 or the rows R1', R2', R3' could be omitted or could be otherwise shaped, arranged, configured, and/or positioned without departing from the disclosure.

In one embodiment, the arrangements 100, 100' and/or other suitable nested arrangements of containers (e.g., having a load width X according to expression 3) can provide a more compact packaging configuration than non-nested arrangements. For example, a carton accommodating a non-nested arrangement having R rows would have an inner width of R times the diameter $D_C$ of the containers in the arrangement, while the nested arrangements according the present disclosure can be accommodated in a carton having an inner loading width that is similar or identical to the load width X according to the expression 3. In addition, the nesting of the containers C in the arrangements 100, 100' can help retain the containers C in position in the interior of the carton, while containers in non-nested arrangements could be more likely to move relative one another (e.g., due to loose packaging in the container) in one embodiment. A further advantage of the nested arrangements can include the interior space provided at the ends of a carton (e.g., the closed ends 130, 132 of the carton 110) by the shorter rows of the nested arrangement (e.g., the inner row R2 or the outer rows R1', R3' of the arrangements 100, 100'). Such interior space can provide clearance for grasping a handle (not shown) or actuating a dispenser (not shown) in the carton. Other advantages are within the scope of the disclosure.

Figure 10:
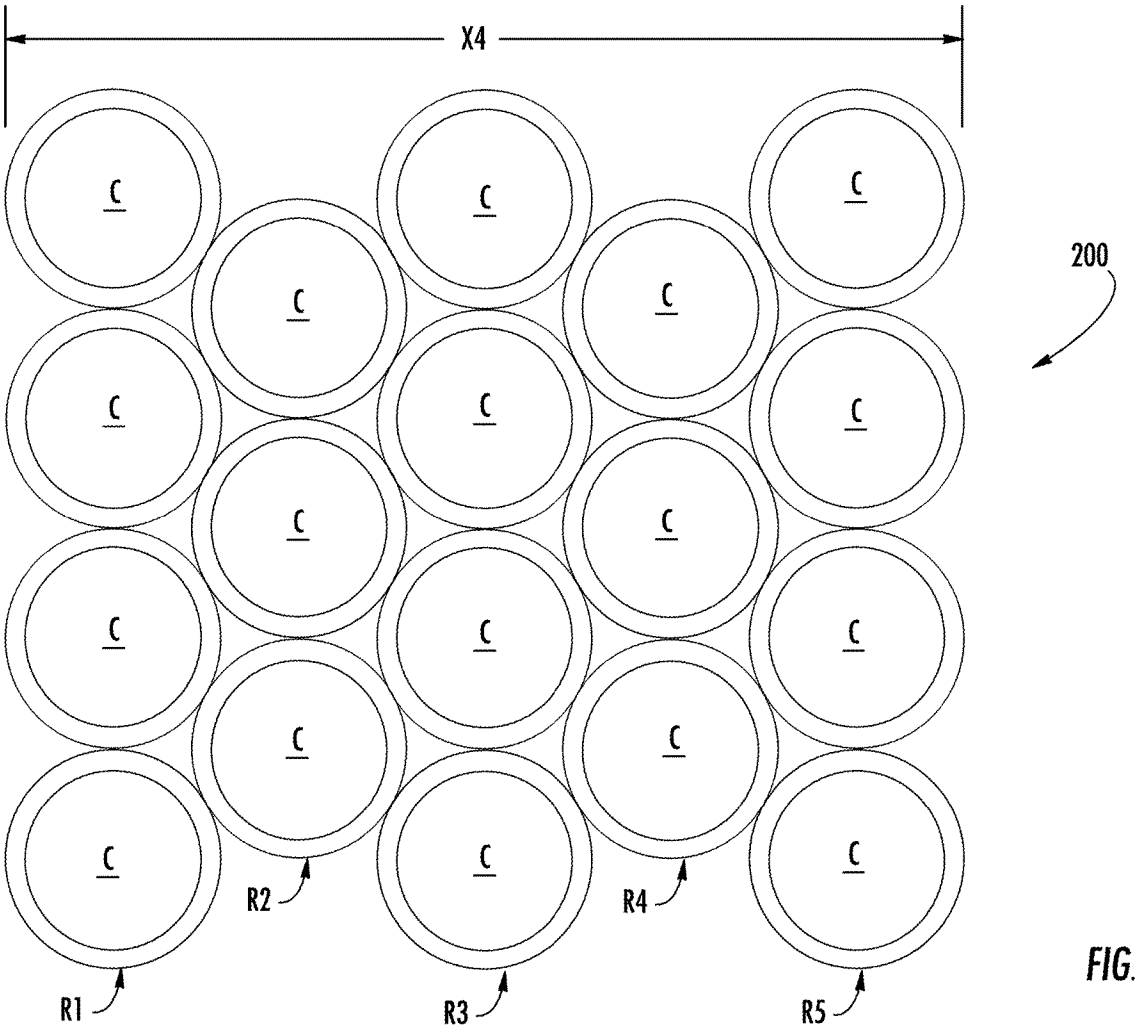
FIG. 10 is a schematic top view of an arrangement of the containers of FIG. 1A according to a second exemplary embodiment of the present disclosure.

FIG. 10 is a schematic top view of an arrangement 200 of the containers C according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 10, the arrangement 200 can be in a 4×3×4×3×4 configuration. Stated another way, the arrangement 200 can have three rows R1, R3, R5 with four containers C each and two rows R2, R4 with three containers C each wherein the row R2 is nested with the rows R1, R3, and the row R4 is nested with the rows R3, R5. In the illustrated embodiment, the width X4 of the arrangement 200 can be determined according to the expression 3 (or the expression 1 or 2) wherein the number of rows R is five. For example, the containers C could be cans having a diameter of approximately 2.6 inches, and the width X4 could be less than approximately 12.4 inches and greater than approximately 10.5 inches in one embodiment. The width of the arrangement 200 can vary (e.g., due to spacing between containers and/or shifting of rows) as described in the first embodiment (e.g., with respect to FIGS. 2A-3C).

Figure 11:
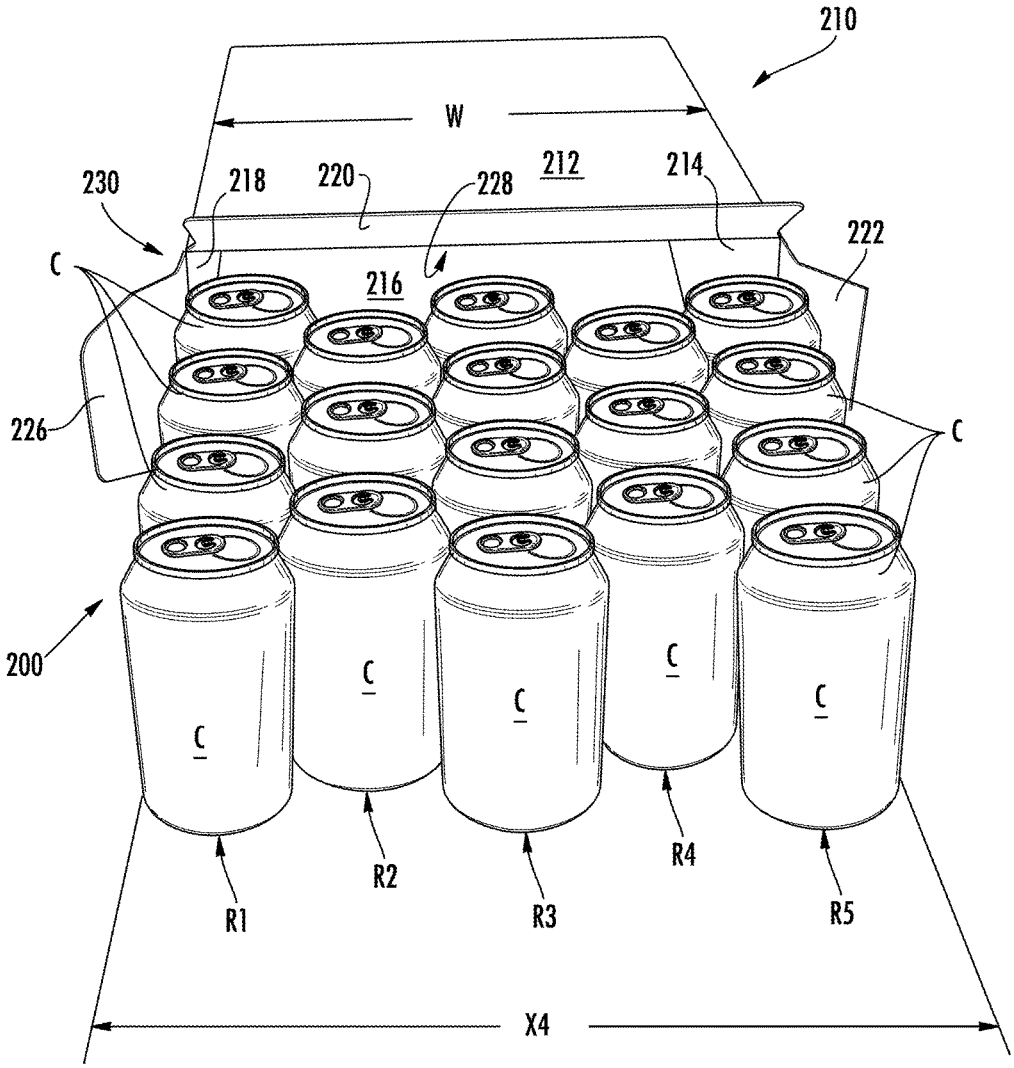
FIG. 11 is a perspective view showing the loading of the arrangement of containers of FIG. 10 into an open-ended carton.
Figure 12:
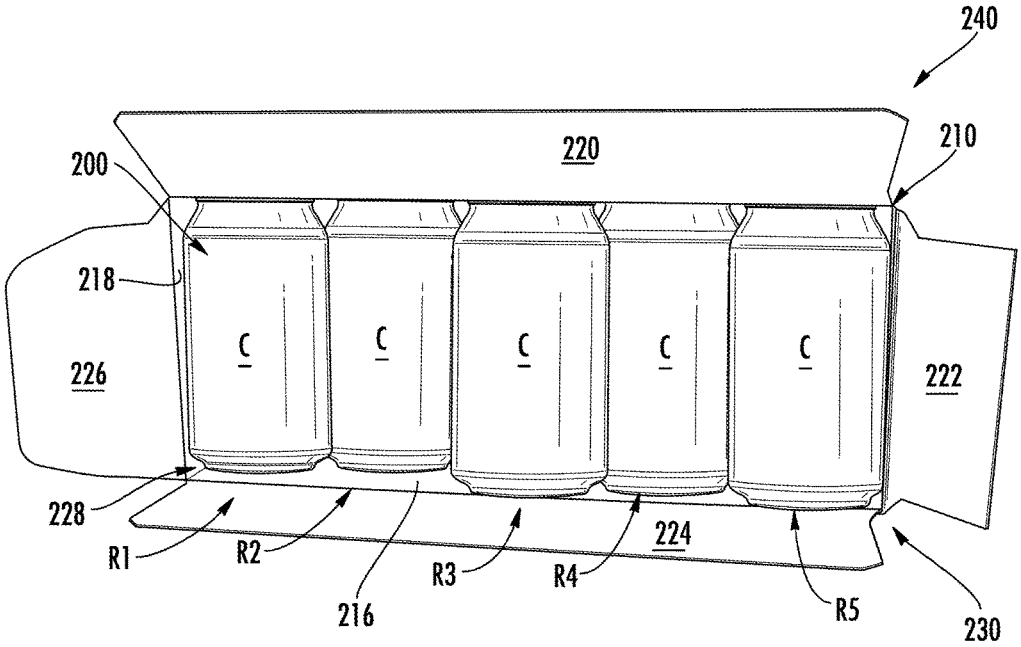
FIG. 12 is an end view of the open-ended carton of FIG. 11 loaded with the containers according to the second exemplary embodiment of the present disclosure.
Figure 13:
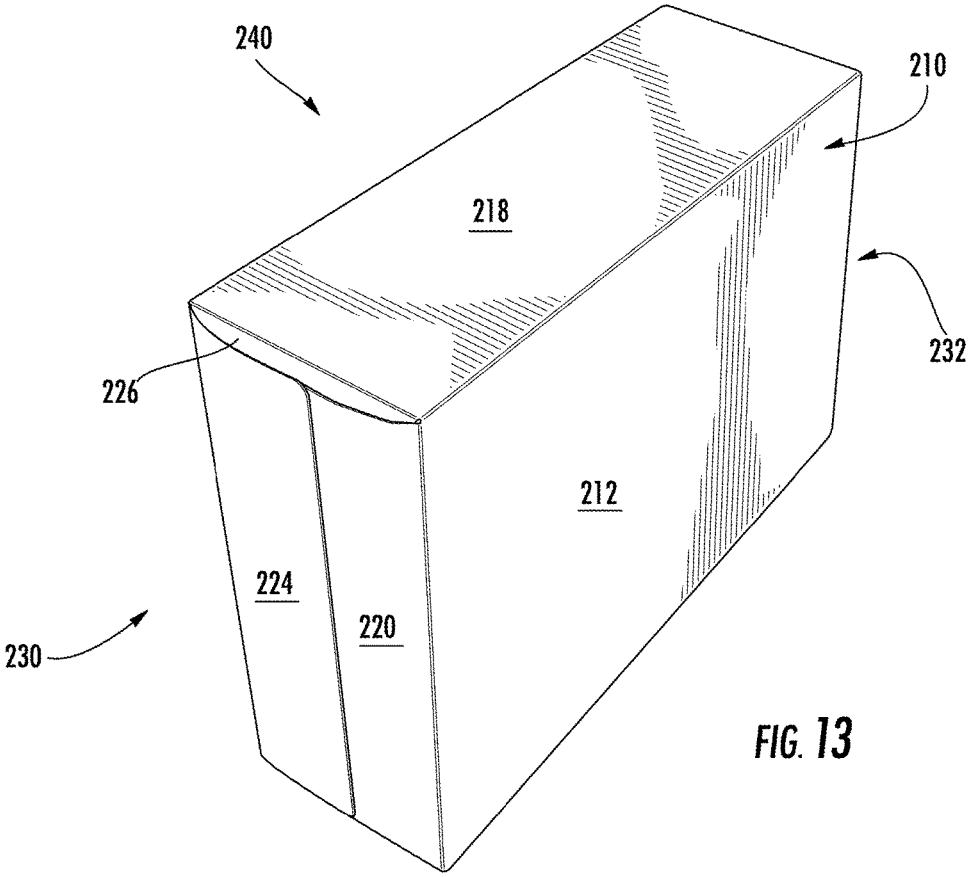
FIG. 13 is a perspective view of the erected carton with closed ends according to the second exemplary embodiment of the present disclosure.

As shown in FIGS. 11 and 12, the arrangement 200 can be loaded into a carton 210 to form a package 240 (FIGS. 12 and 13). The carton 210 can have an interior 228 that is at least partially defined by a first panel 212, a second panel 214, a third panel 216, and a fourth panel 218. In the illustrated embodiment, the width of the carton (e.g., the spacing between the panels 214, 218) can be similar to or the same as the width X4 of the arrangement 200. The ends 230, 232 of the carton 210 can be closed by overlapping the end flaps 220, 222, 224, 226 over the respective ends 230, 232 (FIG. 13). The carton 210 could be otherwise formed and/or the containers C could be otherwise loaded into the interior 228 of the carton without departing from the disclosure. The carton 210 could be otherwise shaped, arranged, configured, and/or positioned without departing from the disclosure.

Figure 14:
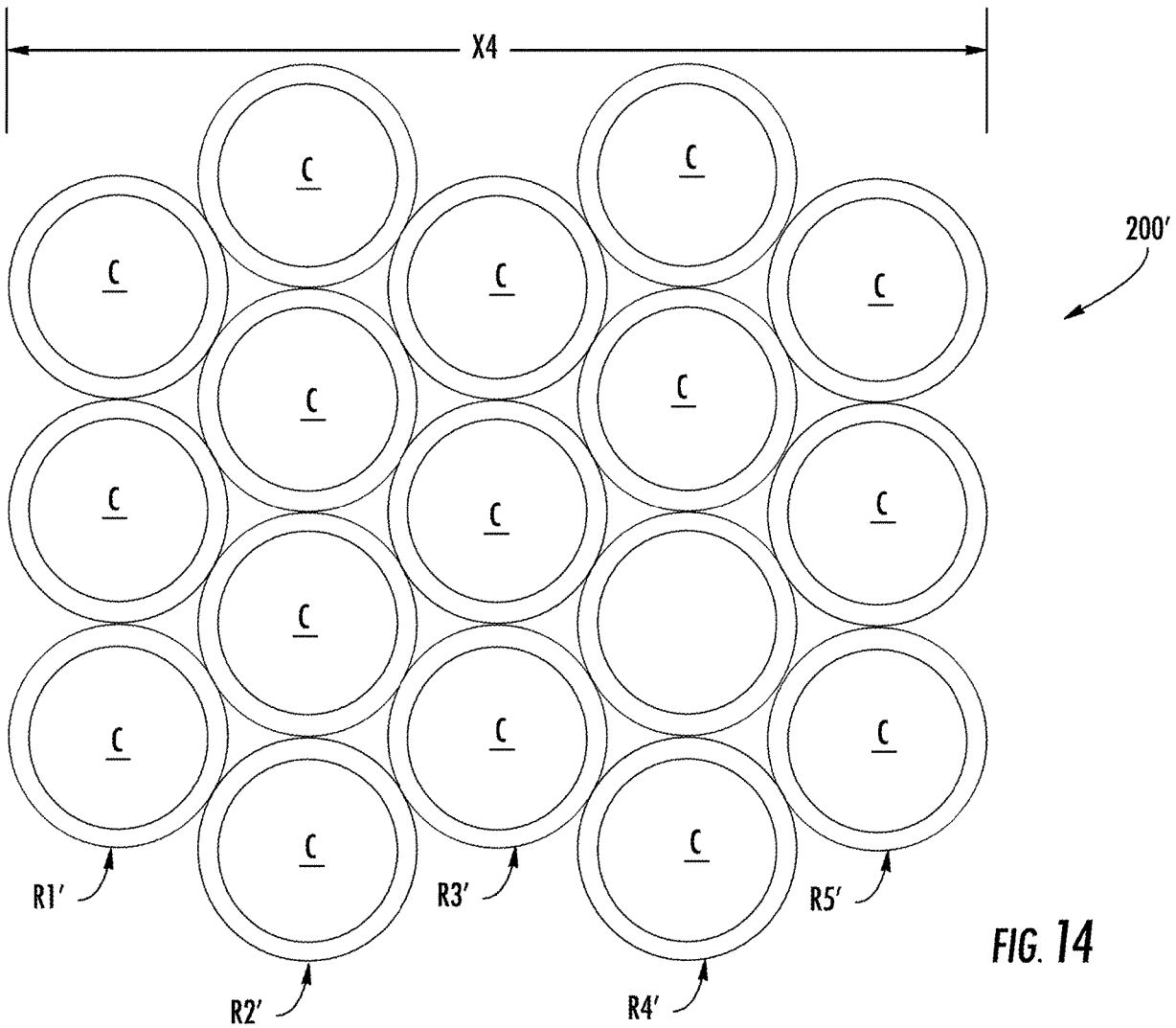
FIG. 14 is a schematic top view of an alternative arrangement of the containers of FIG. 10.

As shown in FIG. 14, the containers C could be disposed in an alternative arrangement 200' (e.g., an externally nested arrangement). In the illustrated embodiment, the arrangement 200' is in a 3×4×3×4×3 configuration wherein three rows R1', R3', R5' have three containers C each and two rows R2', R4' have four containers C each. As shown in FIG. 14, the innermost row R3' is nested with the inner rows R2', R4', which are respectfully nested with the outer rows R1', R5'. In one embodiment, the arrangement 200' can have a width X4 as determined according to one of the expressions 1-3. Any or all of the rows R1, R2, R3, R4, R5 or the rows R1', R2', R3', R4', R5' could be omitted or could be otherwise shaped, arranged, configured, and/or positioned without departing from the disclosure.

Figure 15:
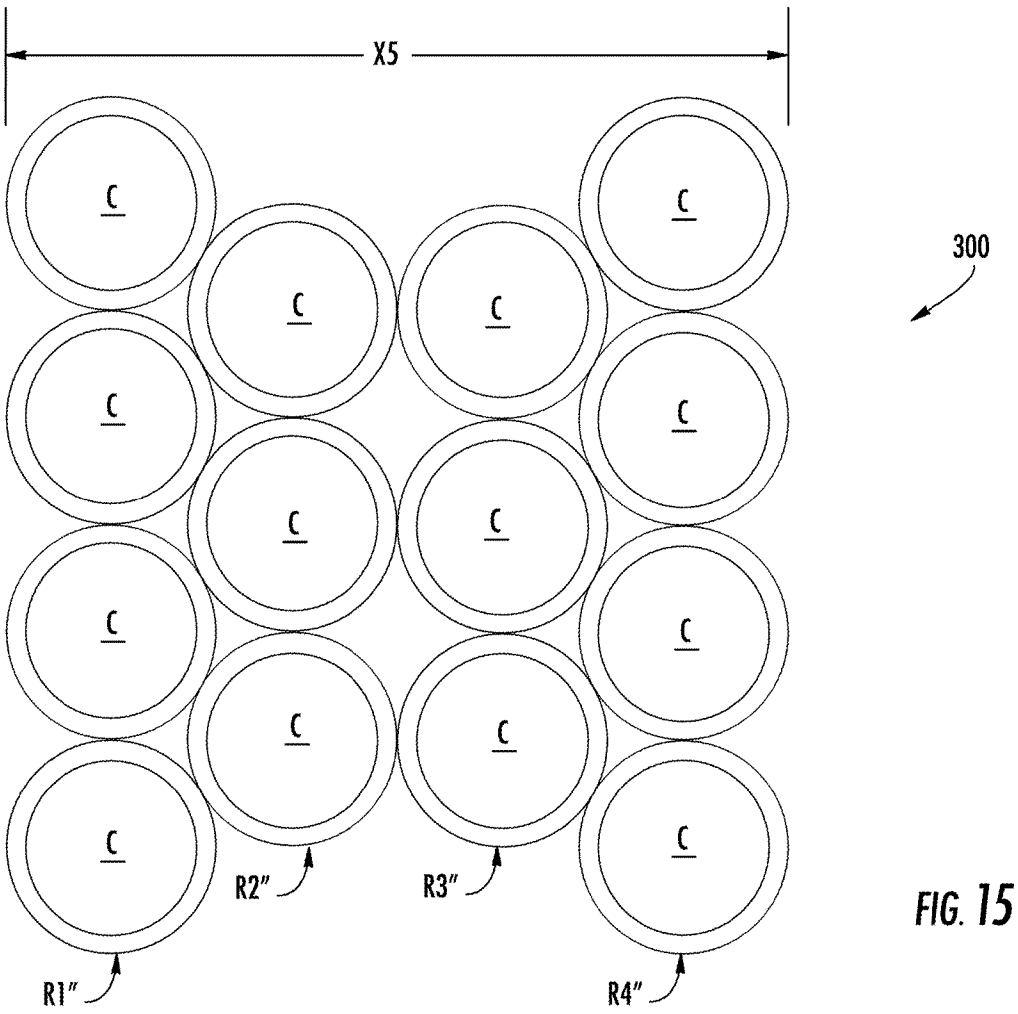
FIG. 15 is a schematic top view of an arrangement of the containers of FIG. 1A according to a third exemplary embodiment of the present disclosure.
Figure 16:
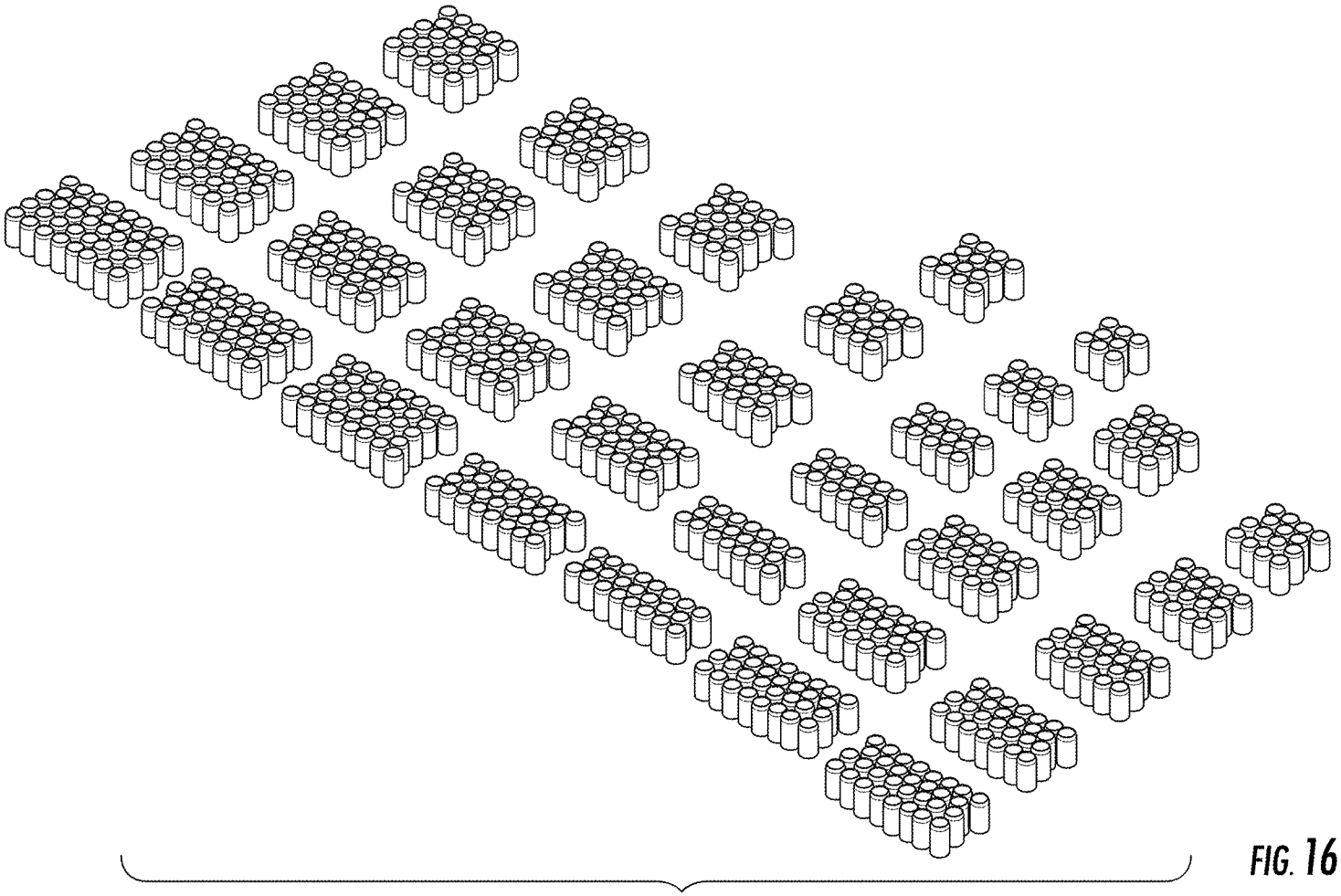
FIGS. 16 and 17 show various perspective views of article arrangements that can be used with various embodiments of the disclosure or alternative embodiments of the disclosure.
Figure 17:
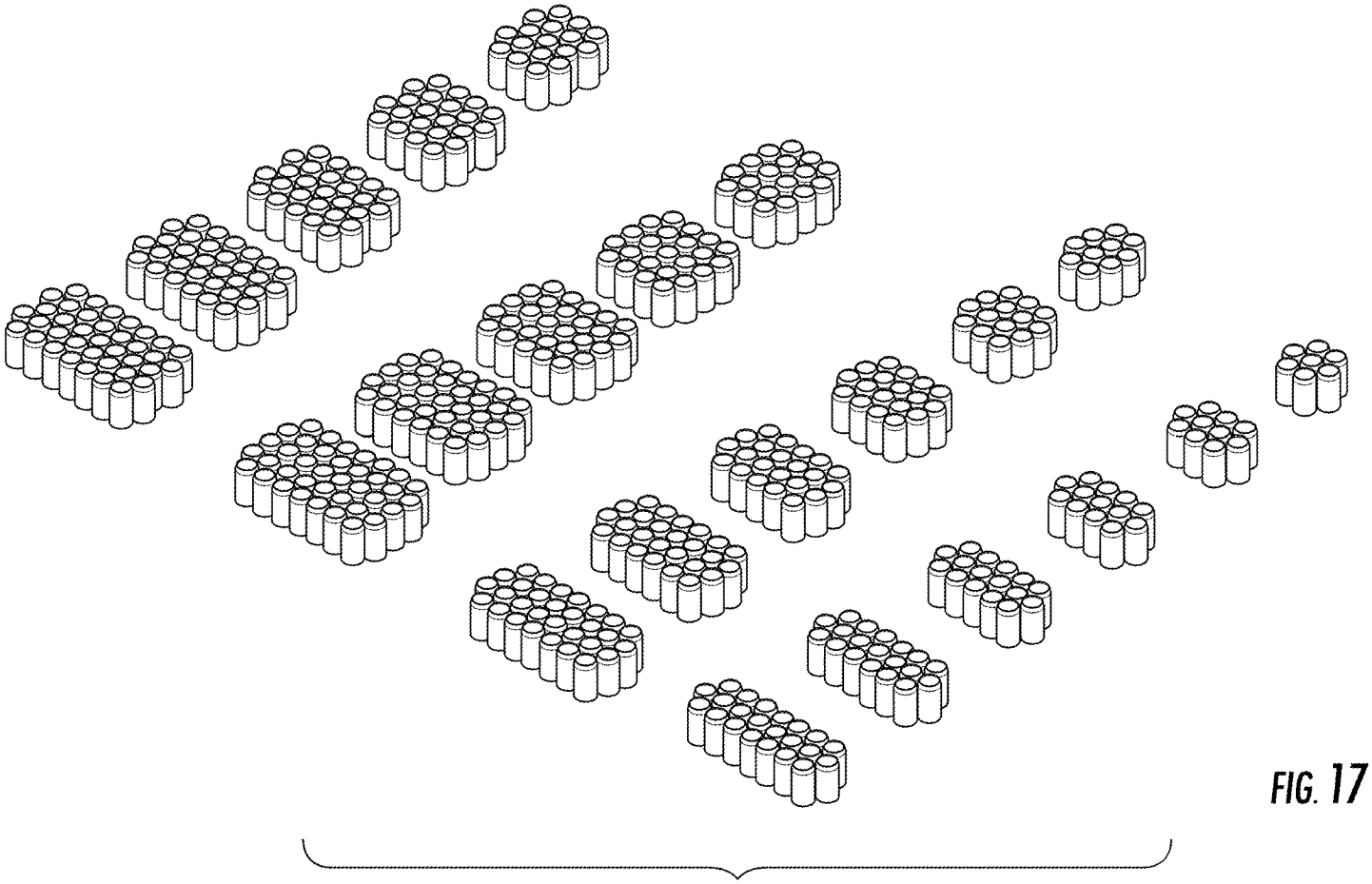

FIG. 15 is a schematic top view of an arrangement 300 of the containers C according to a third embodiment of the disclosure. The third embodiment is generally similar to the first and second embodiments, except for variations noted and variations that will be apparent to one of ordinary skill in the art. Accordingly, similar or identical features of the embodiments have been given like or similar reference numbers. As shown in FIG. 15, the arrangement 300 can be in a 4×3×3×4 configuration. Stated another way, the arrangement 300 can have two outer rows R1", R4" of four containers C each and two inner rows R2", R3" of three containers C each wherein each of the inner rows R2", R3" is nested with the respective outer rows R1", R4". In the illustrated embodiment, the inner rows R2", R3" can be generally aligned with one another so that the inner rows are not nested with one another. In one embodiment, the width X5 of the arrangement 300 can be determined according to one of the expressions 1-3. For example, the width of the arrangement could be less than approximately 9.9 inches and more than approximately 8.4 inches for containers C having a diameter $D_C$ of 2.6 inches. The arrangement 300 could be otherwise shaped, arranged, configured, and/or positioned without departing from the disclosure.

FIGS. 16A-19C and the above incorporated-by-reference applications show exemplary arrangements including fully nested arrangements, internal nested arrangements, and other arrangements of containers that could be used with the illustrated embodiments and/or other non-illustrated embodiments of the disclosure. Additionally, the above incorporated-by-reference applications show alternative carton arrangements that could be incorporated into the above embodiments or other embodiments. Further, the containers C could be disposed in multiple layers (e.g., stacked) in the illustrated embodiments and/or other non-illustrated embodiments of the disclosure.

Any of the features of the various embodiments of the disclosure can be combined with, replaced by, or otherwise configured with other features of other embodiments of the disclosure without departing from the scope of this disclosure. Further, it is noted that the nesting arrangements of the various embodiments can be incorporated into a carton having any carton style or panel configuration. The carton styles and panel configurations described above are included by way of example, and the cartons in the illustrated and non-illustrated embodiments can be sized and shaped accordingly to accommodate the arrangement of the containers B or C.

The blanks according to any of the embodiments of the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

We claim:

1. A method comprising:

obtaining a carton comprising a plurality of panels extending at least partially around an interior of the carton, the plurality of panels comprising at least a first panel and a second panel disposed opposite to one another;

obtaining a plurality of containers, each container in the plurality of containers comprising a diameter and a center, the diameter of each container is between 1 and 4 inches;

forming an arrangement by positioning the containers into a number of rows, the number of rows in the arrangement comprising a plurality of rows, the positioning the containers into the number of rows comprising forming at least a first row and a second row, the forming the arrangement comprising forming a load width of the arrangement, wherein the load width extends from an outermost edge of the first row to an outermost edge of the second row, the load width being less than the number of rows multiplied by a first difference determined by subtracting about an eighth of an inch from the diameter of the containers in the arrangement, and the load width being greater than the number of rows multiplied by a second difference determined by subtracting about a half of an inch from the diameter of the containers in the arrangement, wherein the center of each container is spaced apart from the center of at least one adjacent container by a distance that is greater than the diameter of the containers; and loading the arrangement at least partially into the interior of the carton after the forming the arrangement so that the first row extends along the first panel and the second row extends along the second panel.

2. The method of claim 1, wherein the carton comprises an inner width extending from the first panel to the second panel, and the inner width is approximately equal to the load width of the arrangement.

3. The method of claim 2, wherein the positioning the containers into the number of rows further comprises forming a third row, the third row being spaced apart from the first panel and the second panel by at least the first row and the second row after the loading the arrangement.

4. The method of claim 3, wherein the forming the arrangement further comprises nesting the third row with the first row and the second row, and wherein the number of rows is three so that the load width is less than three multiplied by the first difference and is greater than three multiplied by the second difference.

5. The method of claim 1, wherein the positioning the containers into the number of rows further comprises forming a third row that is at least partially nested with at least one of the first row and the second row.

6. The method of claim 1, wherein the positioning the containers into the number of rows further comprises forming a third row, and at least one of the first row and the second row comprises one more container than the third row.

7. The method of claim 6, wherein the forming the arrangement further comprises nesting the third row at least partially with at least one of the first row and the second row.

8. The method of claim 1, wherein the positioning the containers into the number of rows further comprises forming a third row and a fourth row, the forming the arrangement further comprises nesting the third row at least partially with at least the first row and nesting the fourth row at least partially with the second row.

9. The method of claim 1, wherein the positioning the containers comprises positioning at least one container of each row of the plurality of rows in contact with at least one container in each respectively adjacent row of the plurality of rows.

10. The method of claim 1, wherein the loading the arrangement comprises inserting the arrangement through one open end of the carton.

* * * * *